US010379471B2

(12) United States Patent
Takematsu et al.

(10) Patent No.: US 10,379,471 B2
(45) Date of Patent: Aug. 13, 2019

(54) IMAGE HEATING APPARATUS HAVING A PRESSURE REMOVAL MECHANISM INCLUDING A CAMSHAFT AND A REGULATING PORTION THAT REGULATES FLEXURE OF THE CAMSHAFT

(71) Applicant: CANON KABUSHIKI KAISHA, Tokyo (JP)

(72) Inventors: Koji Takematsu, Abiko (JP); Shutaro Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/939,877

(22) Filed: Mar. 29, 2018

(65) Prior Publication Data

US 2018/0284670 A1 Oct. 4, 2018

(30) Foreign Application Priority Data

Mar. 31, 2017 (JP) ..... 2017-070483
Feb. 1, 2018 (JP) ..... 2018-016321

(51) Int. Cl.
*G03G 15/20* (2006.01)

(52) U.S. Cl.
CPC ..... *G03G 15/206* (2013.01); *G03G 15/2032* (2013.01); *G03G 2215/2025* (2013.01)

(58) Field of Classification Search
USPC ..... 399/107, 110, 122, 320, 328–331
See application file for complete search history.

(56) References Cited

U.S. PATENT DOCUMENTS 7,003,254 B2 * 2/2006 Tokuzaki ..... G03G 15/2032 399/122
7,397,017 B2 7/2008 Hosoi et al.
7,442,905 B2 10/2008 Wakahara et al.
7,465,906 B2 12/2008 Wakahara et al.
8,779,335 B2 7/2014 Saito
8,843,042 B2 9/2014 Nawa et al.
8,843,046 B2 9/2014 Nawa et al.
8,918,044 B2 12/2014 Takematsu et al.
8,958,716 B2 2/2015 Saito
(Continued)

FOREIGN PATENT DOCUMENTS

JP 2010-139732 A 6/2010

*Primary Examiner* — Hoan H Tran
(74) *Attorney, Agent, or Firm* — Venable LLP

(57) ABSTRACT

An image heating apparatus includes a pressure removal mechanism including a camshaft, first and second cam portions being capable of placing a pressing mechanism at a first position, in which first and second rotatable members form the nip, and a second position, in which the pressing mechanism is moved against an urging force provided by a pressing spring at the first position, a first bearing portion, a second bearing portion, a first supporting portion supporting the first bearing portion, a second supporting portion supporting the first bearing portion, a driving mechanism configured to rotate the camshaft, and a regulating portion configured to regulate flexure of the camshaft by contacting the camshaft at a position between the first bearing portion and the second bearing portion with respect to the longitudinal direction of the camshaft, when the pressing mechanism is in the second position.

20 Claims, 16 Drawing Sheets

(56) References Cited

U.S. PATENT DOCUMENTS

| | | | | |
|---|---|---|---|---|
| 8,971,778 | B2 * | 3/2015 | Suzuki | G03G 15/2064 399/329 |
| 2008/0273905 | A1 | 11/2008 | Hosoi et al. | |
| 2009/0020524 | A1 | 1/2009 | Wakahara et al. | |
| 2014/0153938 | A1 | 6/2014 | Saito | |

* cited by examiner

IMAGE HEATING APPARATUS HAVING A PRESSURE REMOVAL MECHANISM INCLUDING A CAMSHAFT AND A REGULATING PORTION THAT REGULATES FLEXURE OF THE CAMSHAFT

This application claims the benefit of Japanese Patent Application No. 2017-070483, filed on Mar. 31, 2017, and No. 2018-016321, filed on Feb. 1, 2018, which are hereby incorporated by reference herein in their entireties.

FIELD OF THE INVENTION AND RELATED ART

The present invention relates to an image heating apparatus for fixing a toner image on a sheet of recording medium. An image heating apparatus can be mounted in an image forming apparatus, such as a copying machine, a printing machine, a facsimile machine, and a multifunction machine that is capable of functioning as two or more of the preceding machines, that employs an electrophotographic image forming method.

An image forming apparatus, which employs an electrophotographic image forming method, forms a latent image on a photosensitive drum, as an image bearing member, develops the latent image into a visible image with the use of a developer (toner), and transfers the visible image (toner image) onto a sheet of recording medium with the use of a combination of electrostatic force and pressure. Then, it fixes the visible image (toner image) to the sheet by applying a combination of heat and pressure to the sheet and the visible image (toner image) on the sheet to the sheet with the use of a fixing apparatus.

A fixing apparatus, such as the one described above, which is employed by an electrophotographic image forming apparatus, is provided with a fixation roller, a pressure roller (pressure applying member), a pressure lever, and pressure application springs, among other features. It is structured so that the pressure roller is kept pressed against the fixation roller by the pressure lever, which is under the pressure from the pressure springs, to form a fixation nip for fixing an unfixed toner image to a sheet of recording medium (roller-based fixing method).

As described in Japanese Laid-open Patent Application No. 2010-139732, an image forming apparatus is structured so that, as a recording medium jam is detected, the pressure lever is moved to move the pressure applying member away from the fixing member to remove pressure from the fixation nip. The reason why pressure is removed from the fixing nip is to prevent damage to the fixing apparatus when a sheet of recording medium remains pinched in the fixation nip of the fixing apparatus, and/or to make it easier for a user to pull the jammed sheet out of the fixation nip. Moreover, removing pressure from the fixing nip prevents the problem that, as the fixing member and the pressure applying member are kept pressed against each other for a substantial length of time, the pressure applying member becomes deformed, or a like problem.

In recent years, there has been a substantial increase in the speed of an image forming apparatus. Thus, in order to ensure that image forming apparatuses remain reliable in fixation and image quality, a desire has been increasing for a fixing apparatus that is substantially higher in the amount of pressure by which the pressing member is pressed upon the fixation belt or the fixing roller, compared to any conventional fixing apparatus, and also, is structured so that the pressing member can be pressed upon, or separated from, the fixation belt or the fixation roller.

According to the method disclosed in Japanese Laid-open Patent Application No. 2010-139732, in order to remove the pressure applied to the fixation nip of the fixing apparatus, a pair of cams attached to lengthwise ends of a cam shaft (rotational shaft), one for one, are rotationally driven to push up a pair of pressure application levers attached to lengthwise ends of a heater holder, one for one, to compress a pair of compression springs, in order to reduce the amount of pressure applied to the heater holder.

This method-is problematic, however, in that, as a fixing apparatus is increased in the amount of pressure applied for fixation in order to increase the apparatus in speed and image quality, the apparatus has to be increased in the amount of pressure to be applied to the pressure removal plates by the pair of lengthwise end cams, which, in turn, increases the amount of load to which the cam shaft is subjected. Thus, it is possible for the cam shaft to bow in such a manner that the portion of the cam shaft, which is between the pair of cam shaft bearings, is displaced in the opposite direction from the portions of the cam shaft, which are on outward side of the pair of cam shaft bearings in terms of the lengthwise direction of the cam shaft, are tilted. As the cam shaft bows, it vibrates as is rotated. Thus, as the cam shaft is rotated, the gear train, through which the cam shaft is driven, becomes unstable in the distance between the rotational axes of the adjacent two gears that mesh with each other, making it possible that the two gears will become briefly unmeshed from each other, and, therefore, the pressure will be unsatisfactorily removed.

SUMMARY OF THE INVENTION

Thus, a primary object of the present invention is to prevent a cam shaft from deforming.

According to one aspect, the present invention provides an image heating apparatus comprising a first rotatable member, a second rotatable member that cooperates with the first rotatable member to form a nip configured to heat a toner image on a recording material, a pressing mechanism including a pressing spring configured to press the first rotatable member toward the second rotatable member at opposite longitudinal end portions of the first rotatable member, a first cam portion provided at one longitudinal end portion and a second cam portion provided at another longitudinal end portion, wherein the first cam portion and the second cam portion are capable of placing the pressing mechanism at a first position in which the first rotatable member and the second rotatable member form the nip, and a second position in which the pressing mechanism is moved against an urging force provided by the pressing spring at the first position and in which a force applied between the first rotatable member and the second rotatable member by the pressing mechanism is less than that in the first position, a shaft portion extending along a longitudinal direction of the rotatable member and including a cam shaft configured to rotate the first cam portion and the second cam portion, a first bearing portion and a second bearing portion provided between the first cam portion and the second cam portion with respect to the longitudinal direction and configured to support the cam shaft, a first supporting portion supporting the first bearing portion, a second supporting portion supporting the first bearing portion, wherein the first supporting portion and the second supporting portion rotatably support the cam shaft, a driving mechanism configured to rotate the cam shaft, and a regulating portion configured to regulate flexure of the cam shaft by contacting the shaft portion at a position between the first bearing portion and the second bearing portion with respect to the longitudinal direction, when the pressing mechanism is in the second position.

Further features of the present invention will become apparent from the following description of exemplary embodiments with reference to the attached drawings.

BRIEF DESCRIPTION OF THE DRAWINGS

Parts (a) and (b) of FIG. 1 are perspective views of the pressure removal mechanism of the fixing apparatus in the first embodiment of the present invention, and is for describing the mechanism.

Figure 9:
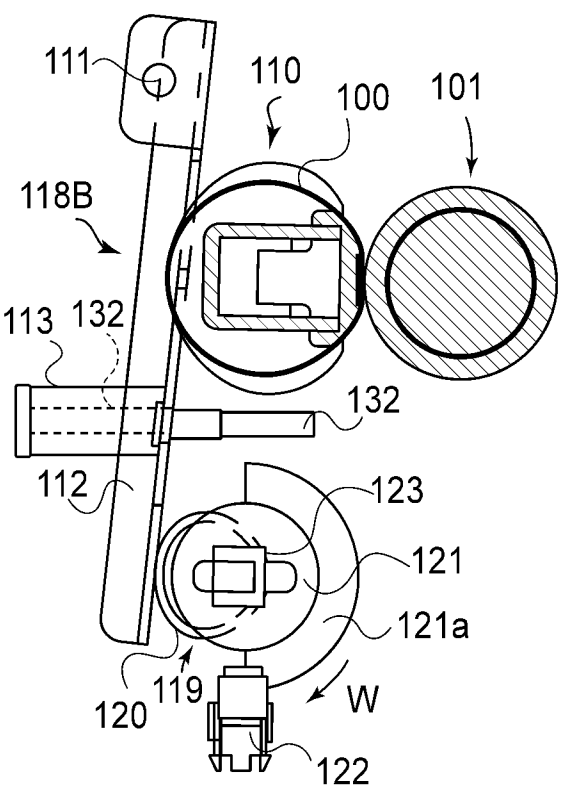
Figure 9:
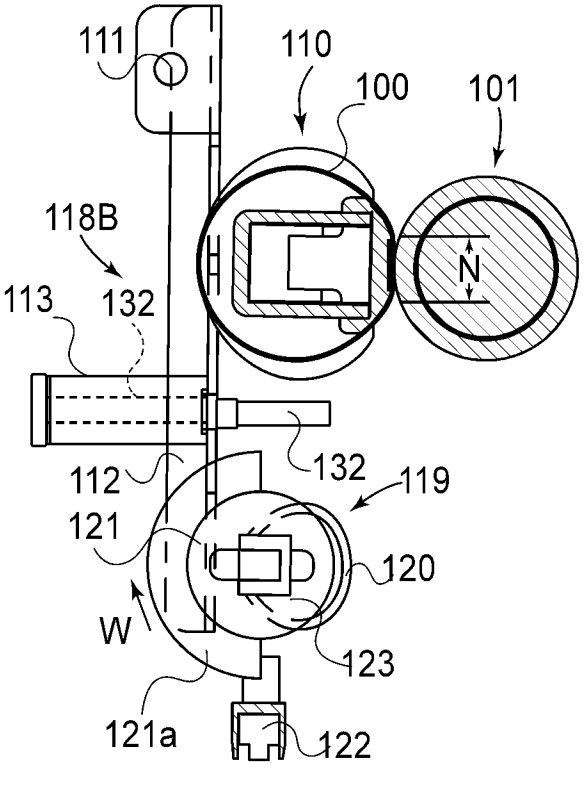

Parts (a) and (b) of FIG. 9 are a combination of a sectional view of the portion of the fixing apparatus, which is related to the present invention, when the fixation belt and the pressure roller are being pressed upon each other by a preset amount of pressure, and a sectional view of the portion of the fixing apparatus, which is related to the present invention, when the fixation belt and the pressure roller are not being pressed upon each other.

Figure 10:
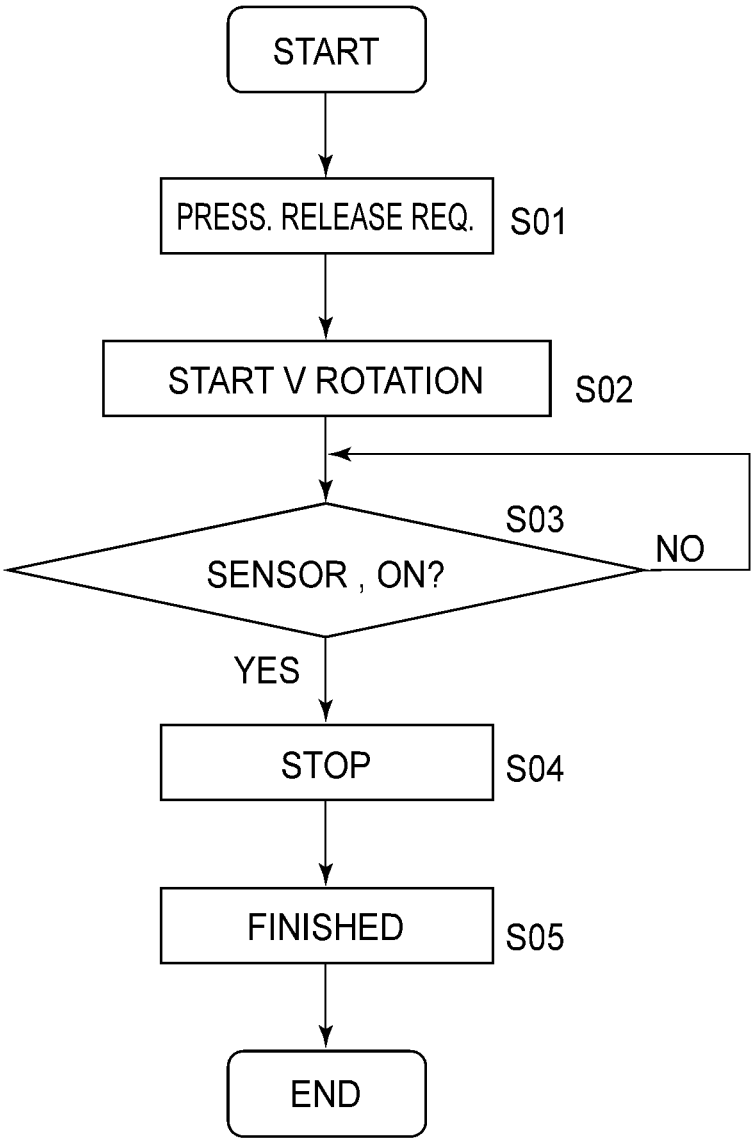

FIG. 10 is a flowchart of the control sequence for preventing the fixation belt unit (fixation belt) from being pressed upon the pressure roller.

Figure 11:
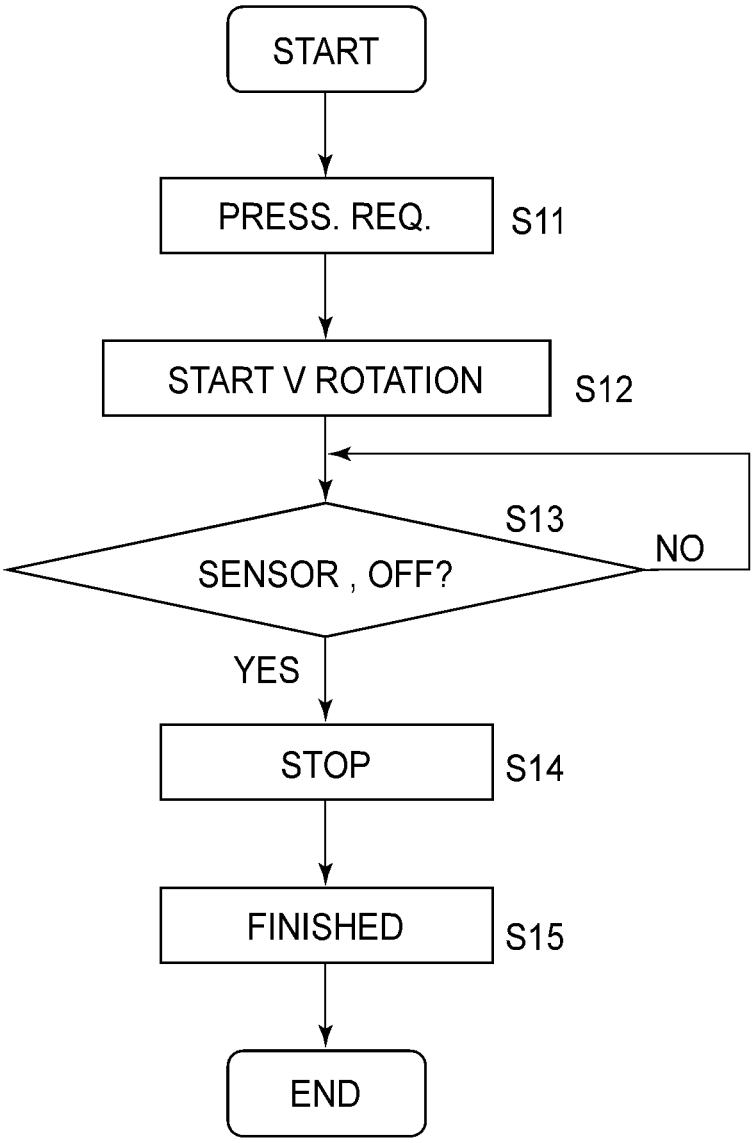

FIG. 11 is a flowchart of the control sequence for allowing the fixation belt unit (fixation belt) to be pressed upon the pressure roller.

Figure 12:
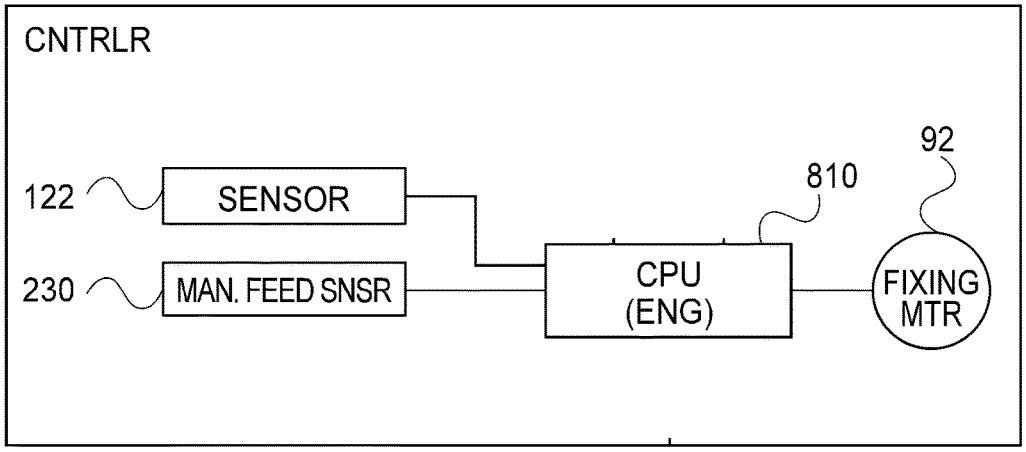

FIG. 12 is a block diagram of a part (engine controller) of the control portion of the image forming apparatus.

Figure 13:
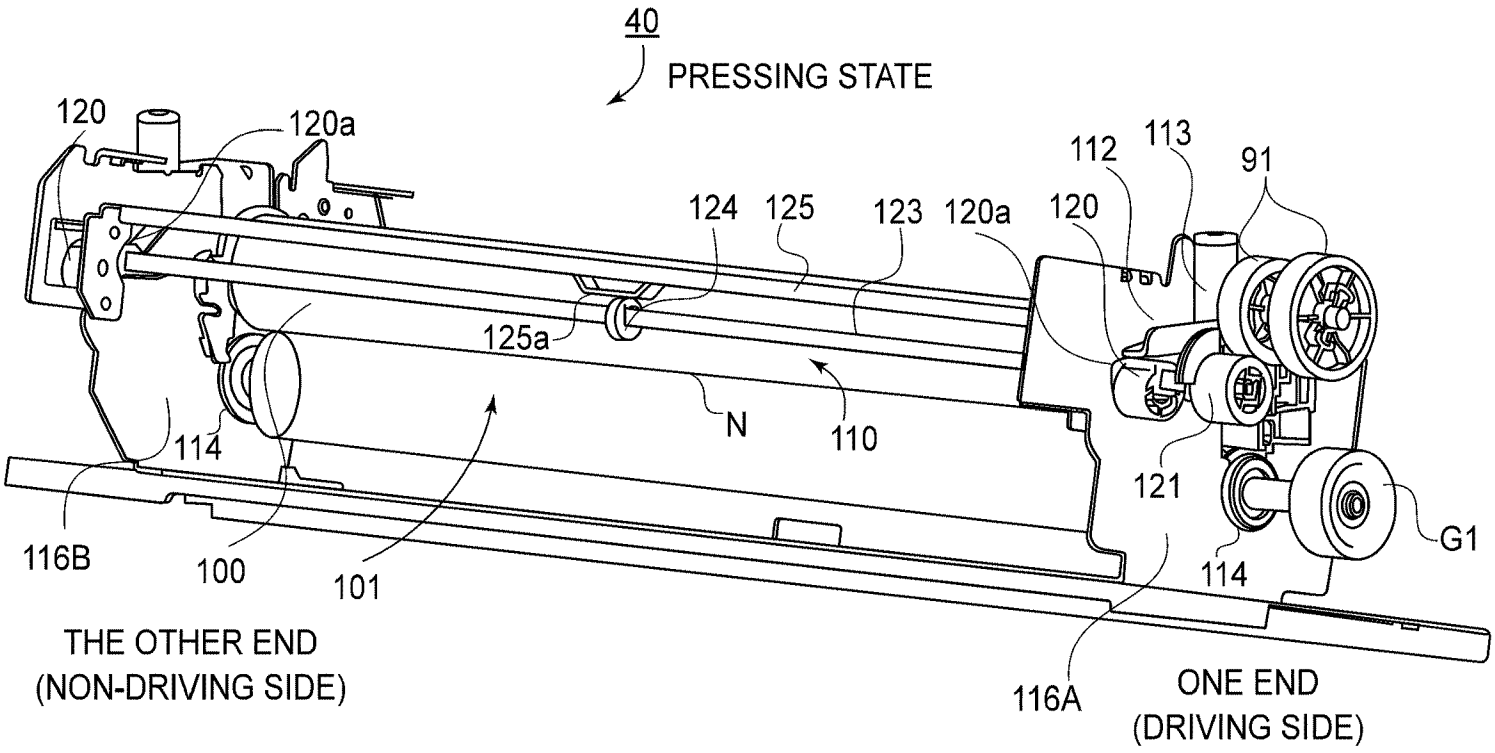

FIG. 13 is a perspective view of the essential portion of the fixing apparatus in the first embodiment, when the fixation belt is being kept pressed upon the pressure roller.

Figure 14:
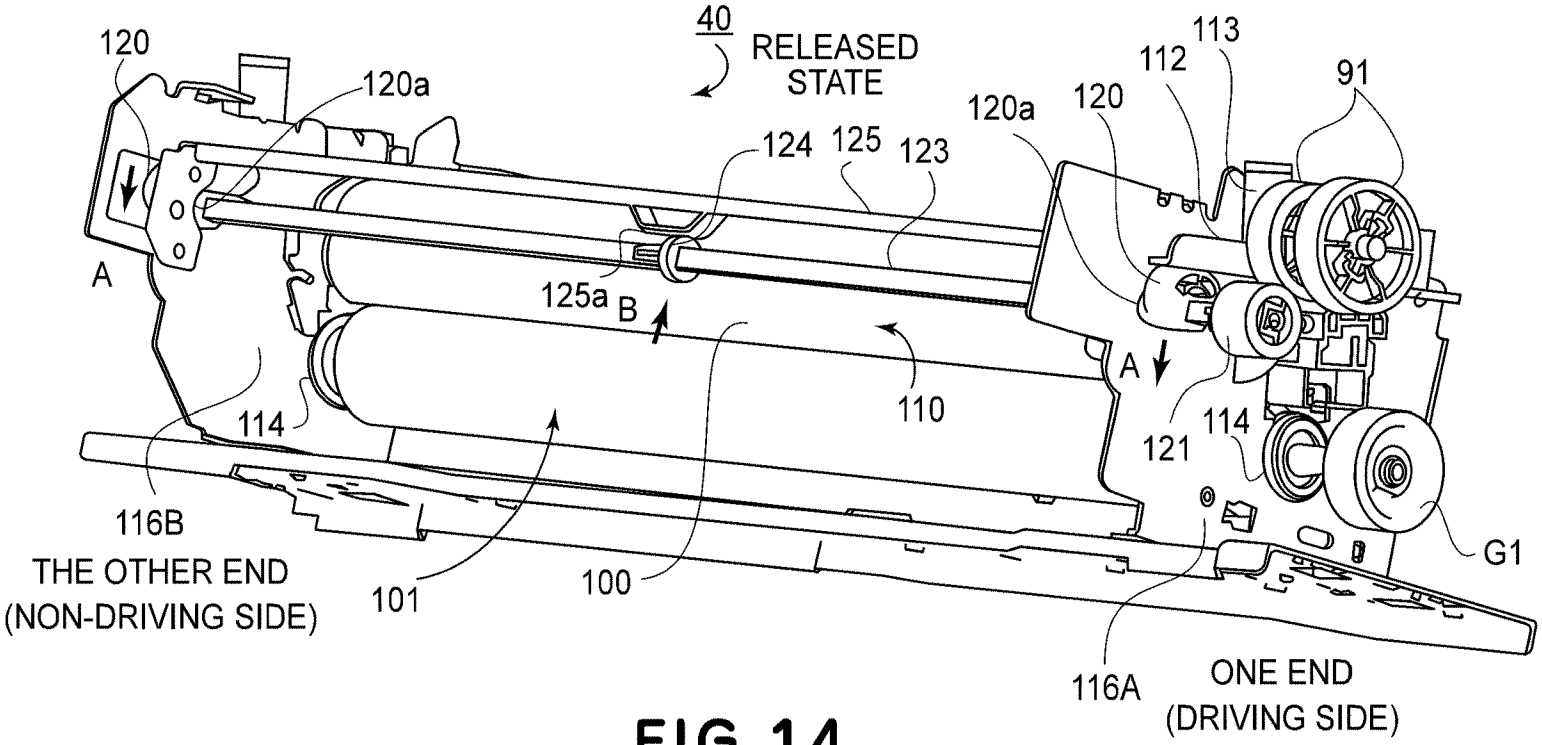

FIG. 14 is a perspective view of the essential portion of the fixing apparatus in the first embodiment, when the fixation belt is not being pressed upon the pressure roller.

Figure 15:
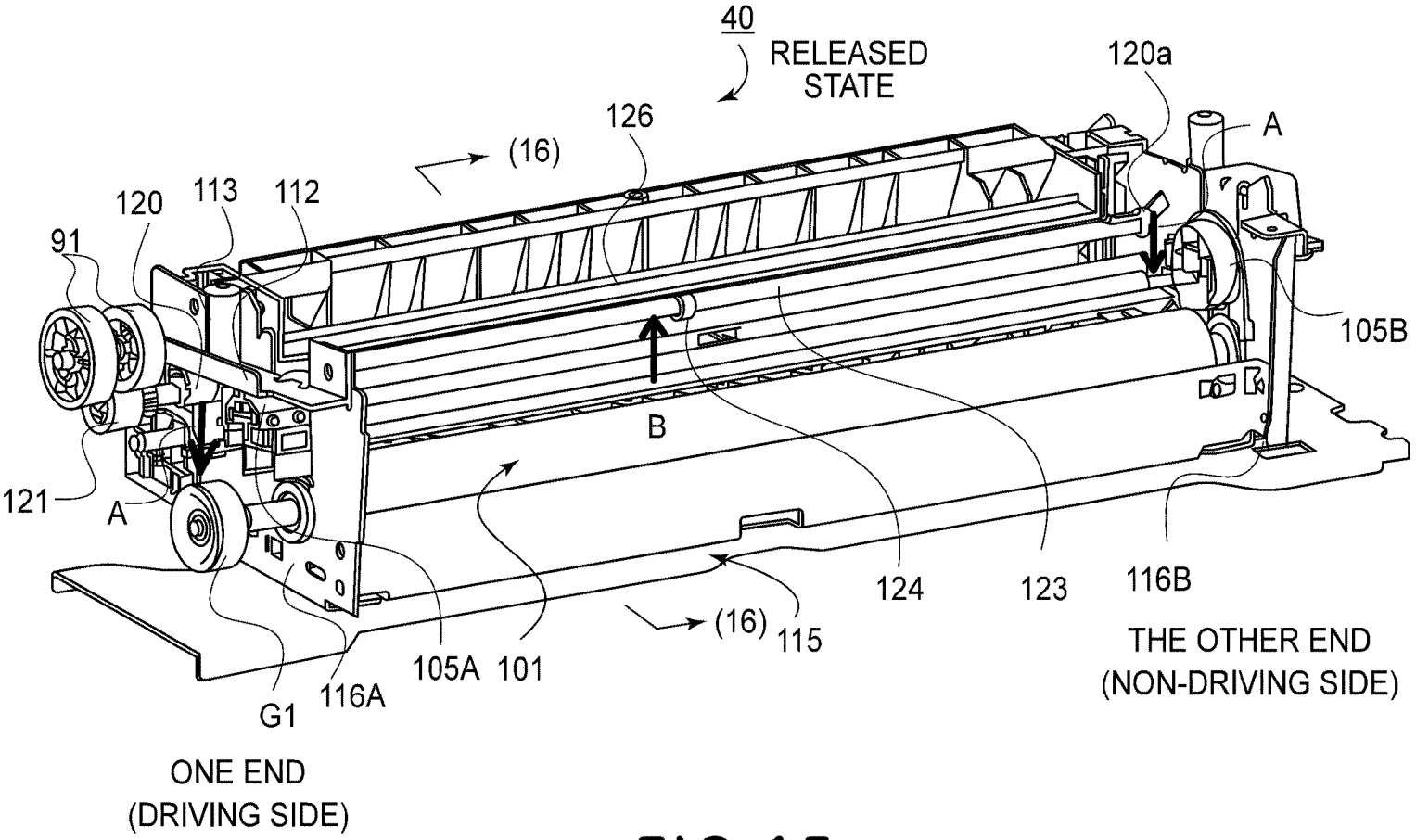

FIG. 15 is a perspective view of the essential portion (except for the belt unit) of the fixing apparatus in the second embodiment of the present invention, when the fixation belt is not being kept pressed upon the pressure roller.

Figure 16:
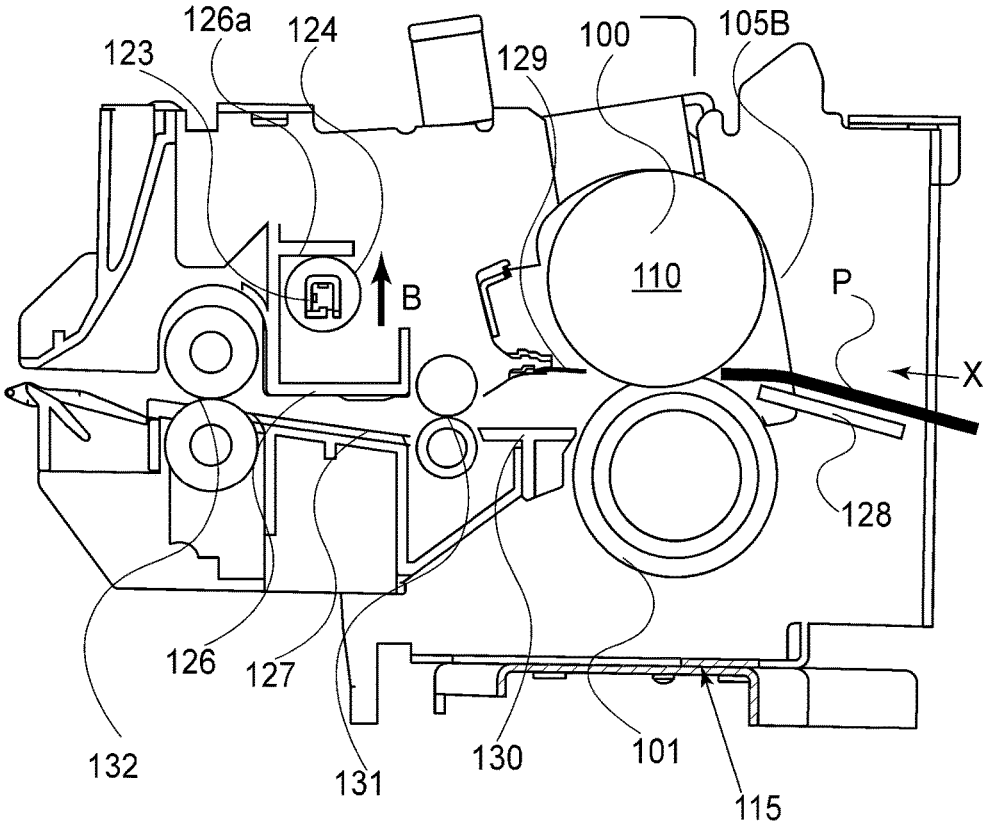

FIG. 16 is a schematic cross-sectional view of the fixing apparatus in the second embodiment of the present invention, when the fixation belt is not being kept pressed upon the pressure roller.

DESCRIPTION OF THE EMBODIMENTS

Hereafter, the present invention is concretely described with reference to a few of the preferred embodiments of the present invention. The following embodiments are not, however, intended to limit the present invention in scope.

Embodiment 1

Image Forming Apparatus

Figure 2:
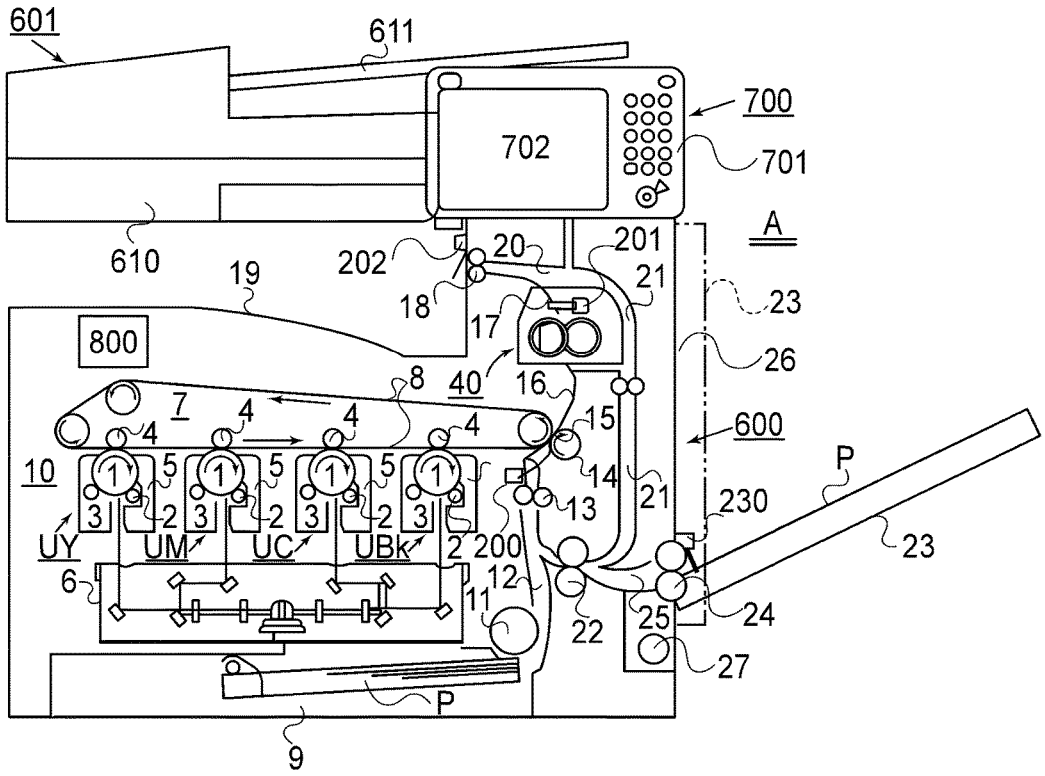
FIG. 2 is a sectional view of an example of image forming apparatus that is compatible with the present invention, and is for describing the structure of the apparatus.

FIG. 2 is a schematic sectional view of the image forming apparatus A in this embodiment, at a plane that is parallel to the direction in which a sheet P of recording medium (paper, for example) is conveyed through the image forming apparatus A. This image forming apparatus A is a digital color copying machine (that hereafter may referred to simply as a copy machine A) of the so-called transfer type, and also, of the so-called tandem type. It uses an electrophotographic image forming method. A sheet P of recording medium is the medium on which a toner image can be formed. Examples of recording medium are a sheet of ordinary paper, a sheet of a resinous substance, a sheet of cardstock, a sheet of film for an overhead projector, and the like.

The copying machine A has an engine portion 600 (main assembly) that forms a toner image on a sheet P of recording medium, and an image reading portion 601 disposed on the top side of the main assembly to read an original (i.e., to obtain image of original). Further, the copying machine A has a control panel portion 700 and a control portion 800. The control panel portion 700 is a part of the forefront of the copying machine A, and is between roughly the mid-point between the engine portion 600 and image reading portion 601. The control portion 800 is on the rear side of the engine portion 600, and controls the operation of the engine portion 600, and that of the image reading portion 601.

The image reading portion 601 is a means for reading an original. The image reading portion 601 is made up of an original placement platen 610 on which an original is placed to be read, and an automatic original feeding apparatus 611 (that hereafter may be referred to as an automatic document feeder (ADF)) that makes it possible for multiple originals to be read in succession. As for the image reading operation of the image reading portion 601, it reads an original placed on the platen 610, or multiple originals placed in the ADF 611, converts the data of the read original (image) into electrical signals, and transmits the signals to a laser scanner 6 of the engine portion 600. The control panel portion 700 has various keys for operating the copying machine A, and a screen 702 (i.e., a touch panel, or an inputting portion) on which various information, such as the condition of the apparatus, is displayed, and through which the apparatus can be operated.

The engine portion 600 is provided with an image forming portion 10 for forming a toner image. The image forming portion 10 has image formation units UY, UM, UC, and UBk for forming toner images of yellow (Y), magenta (M), cyan (C), and black (Bk) colors, respectively. The engine portion 600 has also the laser scanner unit 6, and an intermediary transfer belt unit 7. Each image formation unit UY, UM, UC, and UBk is an electrophotographic image processing system. Each image formation unit UY, UM, UC, and UBk has a photosensitive drum 1, which is rotationally driven, a charging device 2, a developing device 3, a charging device 4 for primary transfer, and a drum cleaner 5.

The electrophotographic process of the image forming portion 10, structured as described above, and the image forming operation of the apparatus are well-known, and, therefore, are not going to be described here. The four toner images, different in color, are transferred (primary transfer) from the rotating four drums 1 of the four image formation units UY, UM, UC, and UBk, one for one, onto the rotating belt 8 of the intermediary transfer belt unit 7, in such a manner that they are layered on the belt 8. As a result, a multicolor toner image is effected by the four toner images, that is, yellow (Y), magenta (M), cyan (C), and black (Bk) toner images, on the belt 8.

Meanwhile, the feed roller 11 begins to be driven with preset timing. As the feed roller 11 is driven, the sheets P of recording paper in a sheet feeder cassette 9 are moved out one by one from the cassette 9, and then, are conveyed to a pair of registration rollers 13 through a sheet conveyance passage 12. The pair of registration rollers 13 catch the sheet P while the rollers 13 are not being rotated. Thus, as the sheet P is caught by the pair of registration rollers 13, it is corrected in attitude if it is delivered askew to the rollers 13. After catching the sheet P while being kept stationary, the pair of registration rollers 13 begin to be rotated in synchronism with the conveyance of the toner image by the belt 8, so that the sheet P reaches the secondary transfer nip 15, which is the nip formed between the belt 8 and the secondary transfer roller 14 as the belt 8 is pressed upon the secondary transfer roller 14, at the same time as the toner image. Then, the sheet P is conveyed through the secondary transfer nip 15. While the sheet P is conveyed through the secondary transfer nip 15, the layered four toner images, different in color, on the belt 8 are transferred together (secondary transfer) onto the sheet P by the secondary transfer roller 14.

After being conveyed through the secondary transferring portion 15, the sheet P is conveyed through a pre-fixation sheet conveyance passage 16. Then, it is introduced into the fixing apparatus 40 (fixing portion) through the sheet entrance of the fixing apparatus 40, which faces downward. Then, the sheet P is conveyed through the fixing apparatus 40. While the sheet P is conveyed through the fixing apparatus 40, it is heated and pressed. Consequently, the toner image becomes fixed to the sheet P. When the image forming apparatus A (copying machine) is in a one-sided mode, that is, a mode in which a toner image is to be formed on only one of two surfaces of the sheet P, the sheet P is guided toward a pair of discharge rollers 18 by a flapper 17 (that is switchable in attitude) as the sheet P comes out of the sheet outlet of the fixing apparatus 40, which faces upward. Then, the sheet P is discharged, as a finished product (print), into a delivery tray 19 by the pair of discharge rollers 18.

The movement of the sheet P when the image forming apparatus A is in a two-sided mode, that is, a mode for forming an image on both surfaces of the sheet P, is as follows. As the sheet P having a toner image on one of its two surfaces comes out of the fixing apparatus 40, it is conveyed toward the tray 19 by the pair of discharge rollers 18. Then, as the trailing end of the sheet P reaches a switch-back point 20, the pair of discharge rollers 18 are rotated in reverse. Thus, the sheet P is conveyed backward into a sheet conveyance passage 21 for the two-sided mode. Then, it is reintroduced into a sheet conveyance passage 12 by a pair of sheet conveyance rollers 22, upside down, that is, the surface having a toner image facing the opposite direction from the direction in which it was facing when the sheet P was conveyed for the first time through the passage 12. Then, the sheet P is put through the same process as the one through which it was put in the one-sided mode. As a result, the sheet P is discharged, as a two-sided product (print), that is, a product (print) having an image on both surfaces, into the delivery tray 19.

By the way, the portion of the image forming apparatus A that is made up of the flapper 17 and the discharge rollers 18 (reversely rotatable) is an example of a sheet reversing means. In this embodiment, the pair of discharge rollers 18 are utilized as the means for placing a sheet P of recording medium upside down. From the standpoint of improving an image forming apparatus in productivity (in printing (image formation)), however, an image forming apparatus may be structured so that a sheet P of recording medium is placed upside down with the use of other means, i.e., means other than the pair of discharge rollers 18. For example, an image forming apparatus may be provided with a portion dedicated to reversing, two sheet discharging portions, etc.

The image forming apparatus A is provided with a sheet feeder tray 23 (also referred to as a manual feed portion for manually feeding a sheet P of recording medium), in addition to the sheet feeder cassette 9. The sheet feeder tray 23 is provided in consideration of such a situation that, when it is desired to form an image on recording medium other than a sheet P of paper, which is placeable in the sheet feeder cassette 9, the sheet P can be easily set for image formation.

The process for forming an image on a sheet P of recording medium fed into the main assembly by way of the manual feed portion 23 (sheet feeder tray) is as follows. As the feed roller 24 is driven with preset timing, the sheets P of recording medium set on the manual feed portion 23 are sent one by one into the main assembly. Then, each sheet P is conveyed though a sheet conveyance passage 25, and is introduced into the post-feeding sheet conveyance passage 12, which is on the upstream side of the pair of registration rollers 13, by the sheet conveyance rollers 22. The process through which the sheet P is put through to form an image on the sheet P fed through the manual feed portion 23 is the same as the one when a sheet of recording medium is fed from the sheet feeder cassette 9. The manual feed portion 23 is provided with a sensor 230 for detecting the presence (or absence) of a sheet P of recording medium on the manual feed portion 23, making it possible for the control portion 800 to detect the presence (or absence) of a sheet P of recording medium on the manual feed portion 23.

The sheet conveyance passages are provided with sheet detection sensors as means for detecting the state of a sheet P of recording medium while the sheet P is conveyed through the sheet conveyance passages. In the case of the copying machine A shown in FIG. 2, a registration sensor 200 is disposed on the downstream side (in terms of recording medium conveyance direction) to detect the sheet P, and an internal sheet sensor 201 is disposed on the downstream side of the fixing apparatus 40 to detect the sheet P. Further, a sheet discharge sensor 202 is disposed on the downstream side of the pair of discharge rollers 18 to detect the sheet P.

The engine controller 801 (FIG. 12) of the control portion 800 proceeds from one image formation step to the other in response to the signals sent from these sensors 200, 201, and 202. For example, if the length of time any of the sensors is on while a sheet P of recording medium is conveyed through the sheet conveyance passages is longer than a preset value, and/or if the arrival of the sheet P at any of the sensors is later than the preset point in time in the operational sequence, a central processing unit (CPU) 810 (FIG. 12) determines that the sheet P became stuck (jammed) somewhere in the sheet conveyance passages (jam has occurred). Then, the CPU 810 stops each of the roller driving portions (unshown) in response to the sheet detection signal(s), in order to prevent the worsening of the paper jam.

Figure 3:
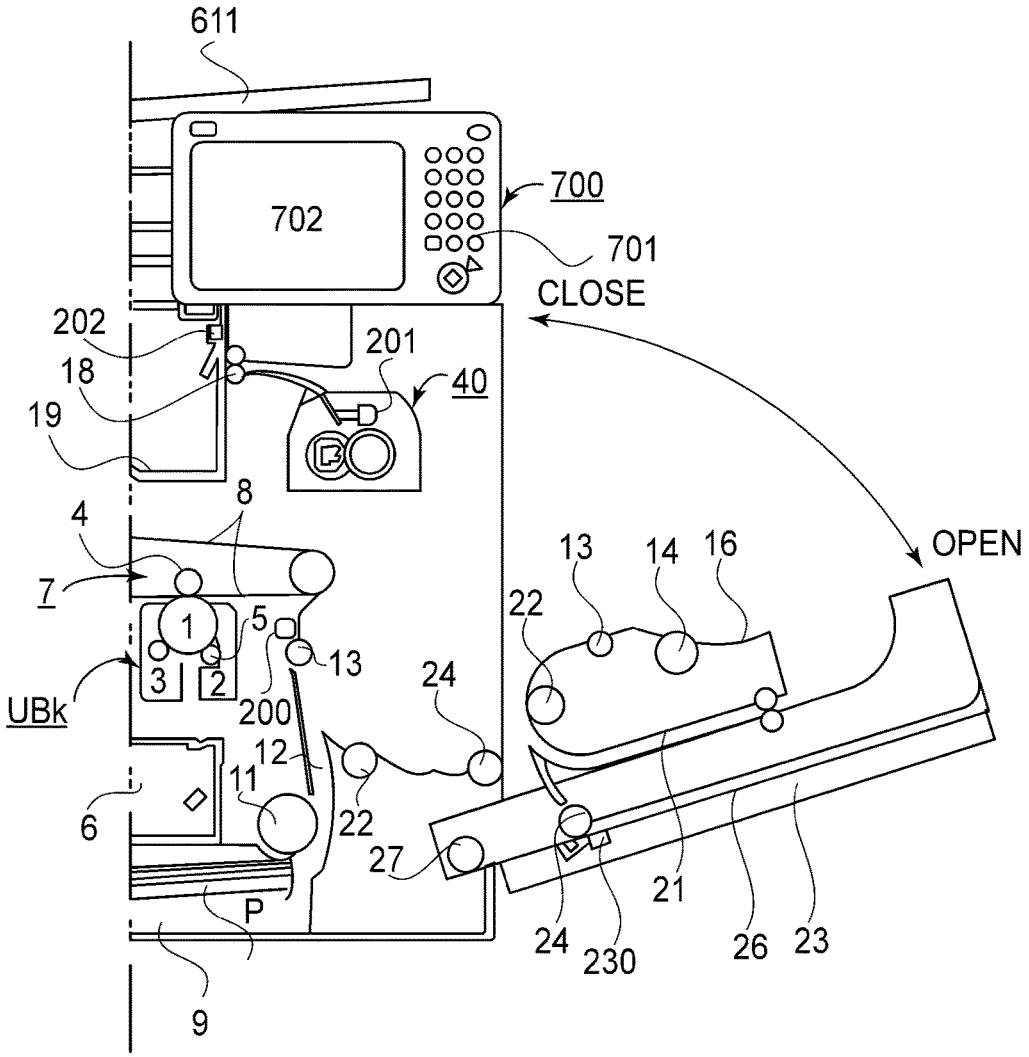
FIG. 3 is a drawing for describing a method for dealing with the paper jam in an image forming apparatus.

The engine portion 600 (main assembly of image forming apparatus) is provided with a door 26, which is for removing the jammed sheet P of paper from the interior of the apparatus, after the sheet P became stuck (jammed) in the apparatus and any of the sensors detected the jam. The door 26 is rotatable about a hinge 27, rightward of the engine portion 600, with reference to FIG. 3, to be opened. The pre-fixation sheet conveyance passage 16, the secondary transfer roller 14, and one (i.e., a right one in FIG. 3) of the pair of registration rollers 13 are attached to the door 26. Therefore, as the door 26 is opened, the recording medium conveyance passage from roughly the mid-point of the post-feeding recording medium conveyance passage 12 to the pair of registration rollers 13 is exposed except for the fixing apparatus 40. Thus, the jammed sheet P of recording medium in the recording medium conveyance passage can be easily removed.

By the way, when the manual feed portion 23 is not in use, it can be folded up against the outward surface of the door 26 as indicated by a double-dot chain line in FIG. 2. When the manual feed portion 23 is needed for image formation, it can be pivoted away rightward from the outward surface of the door 26 until the angle between the door 26 and the manual feed portion 23 becomes a preset one, as indicated by a solid line in FIG. 2.

Fixing Apparatus

Figure 4:
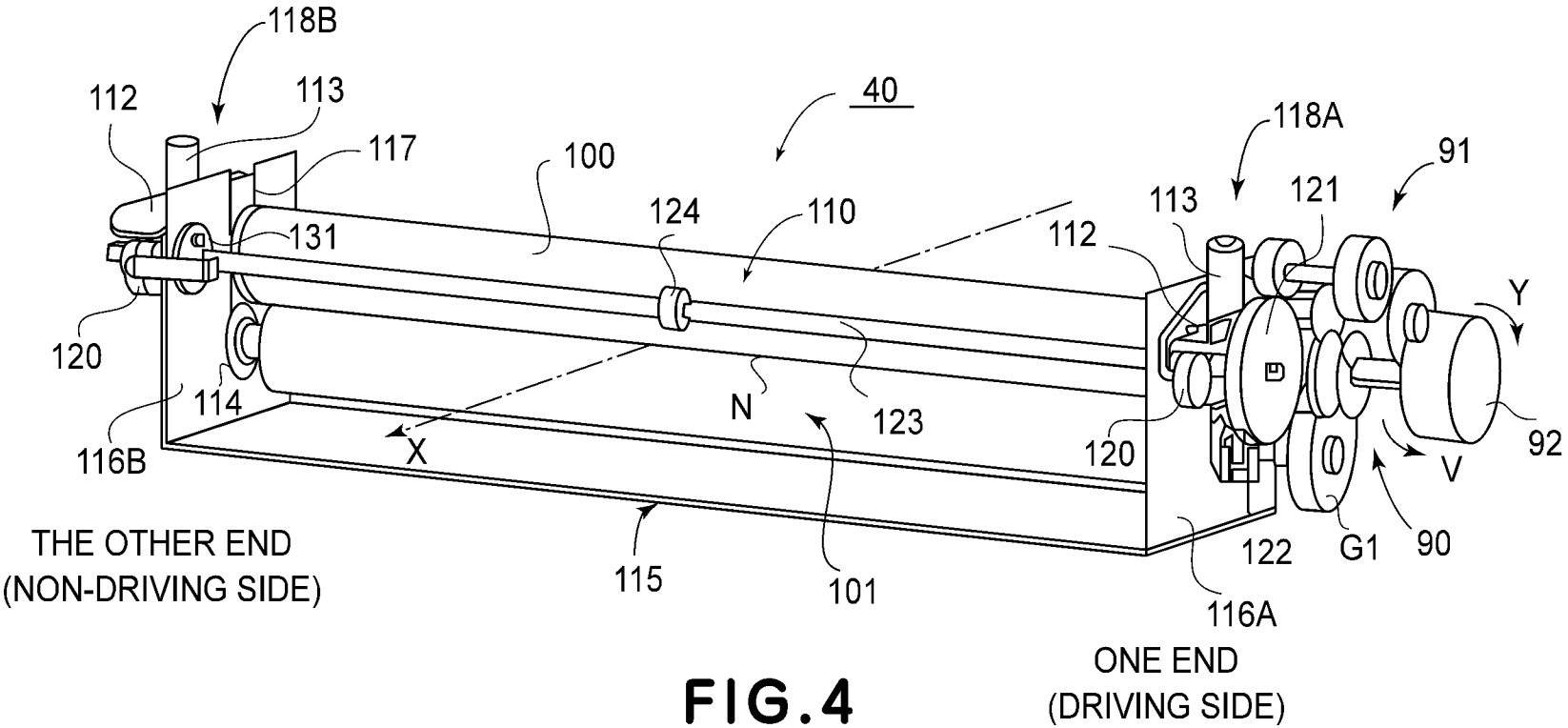
FIG. 4 is an external perspective view of the essential portion of the fixing apparatus in the first embodiment.
Figure 5:
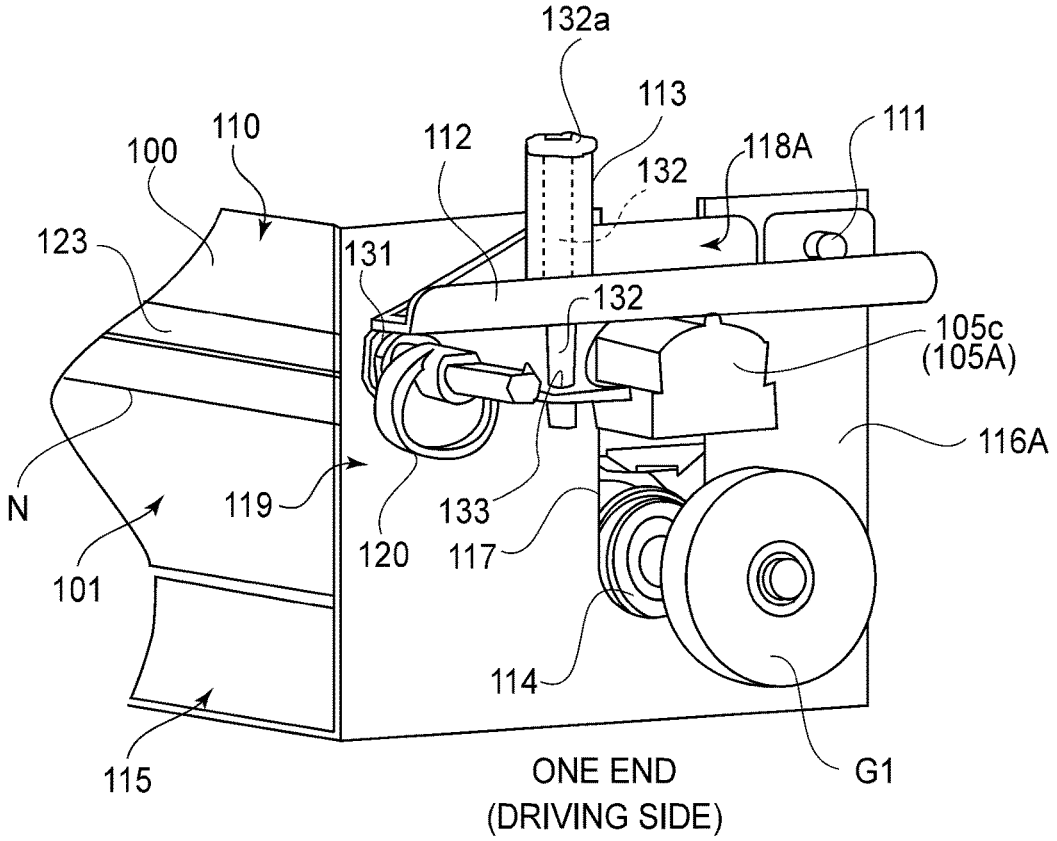
FIG. 5 is a schematic perspective view of the essential portion of one of the lengthwise ends (i.e., an end from which the apparatus is driven) of the fixing apparatus.
Figure 6:
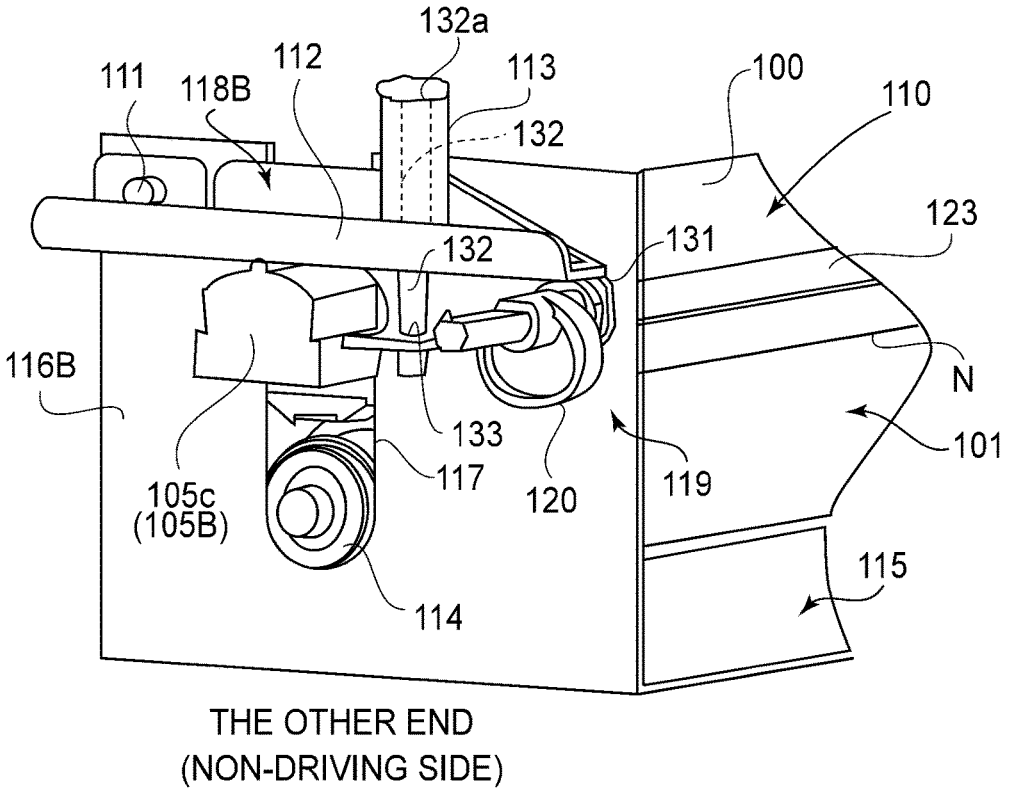
FIG. 6 is a schematic perspective view of the essential portion of the other of the lengthwise ends (i.e., an end from which the apparatus is not driven) of the fixing apparatus.
Figure 7:
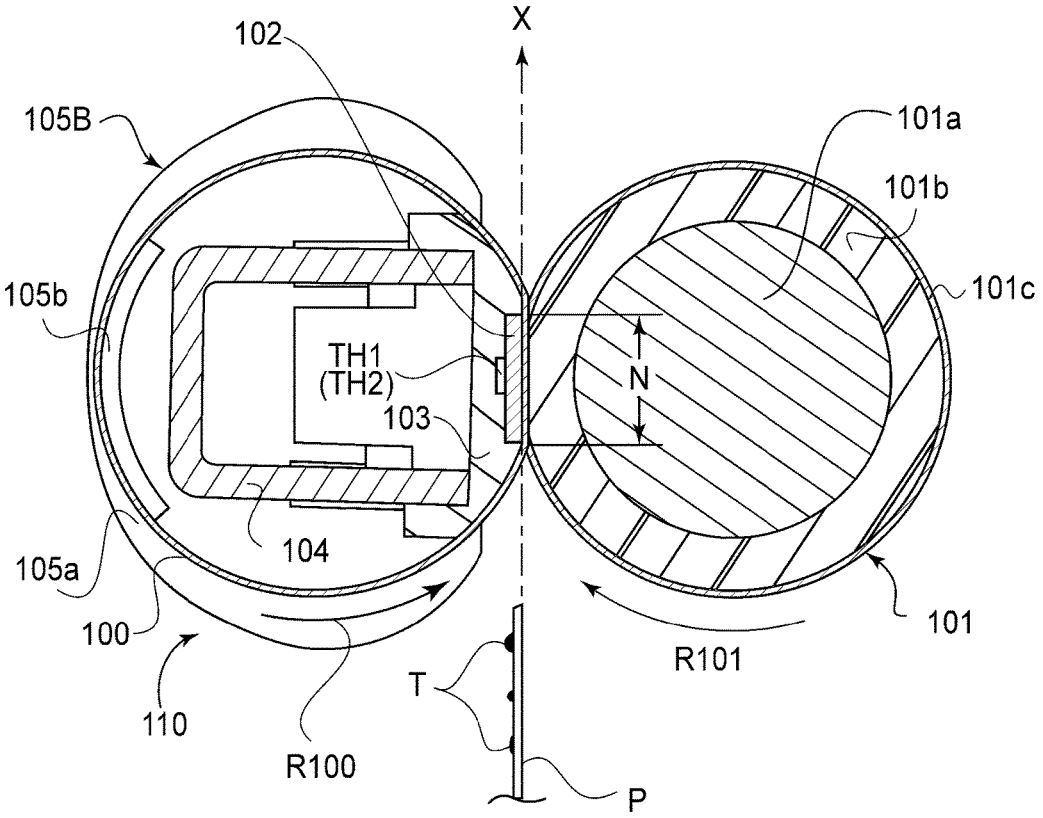
FIG. 7 is an enlarged schematic cross-sectional view of the essential portion of the fixing apparatus.

FIG. 4 is an external schematic perspective view of the fixing apparatus 40. FIG. 5 is a schematic perspective view of the essential portion of one of the lengthwise end portions (i.e., a lengthwise end portion from which the fixing apparatus is driven) of the fixing apparatus 40. FIG. 6 is a schematic perspective view of the essential portion of another lengthwise end portion (i.e., a lengthwise end portion from which the fixing apparatus is not driven) of the fixing apparatus 40. FIG. 7 is an enlarged schematic cross-sectional view of the essential portion of the fixing apparatus 40.

This fixing apparatus 40 is an image heating apparatus of the so-called heating belt type. Generally speaking, it is made up of a fixation belt unit 110 having a fixation belt 100 (first rotational member, or simply belt), an elastic pressure roller 101 (second rotational member), and a frame 115 (casing) in which the fixation belt unit 110 and the elastic pressure roller 101 are contained. A combination of the pair of rotational members, that is, the fixation belt 100 and the pressure roller 101, forms a nip N (fixation nip). The nip N is a portion of the fixing apparatus 40 through which a sheet P of recording medium, which is bearing an unfixed toner image T, is conveyed to apply heat and pressure to fix the toner image.

Figure 8:
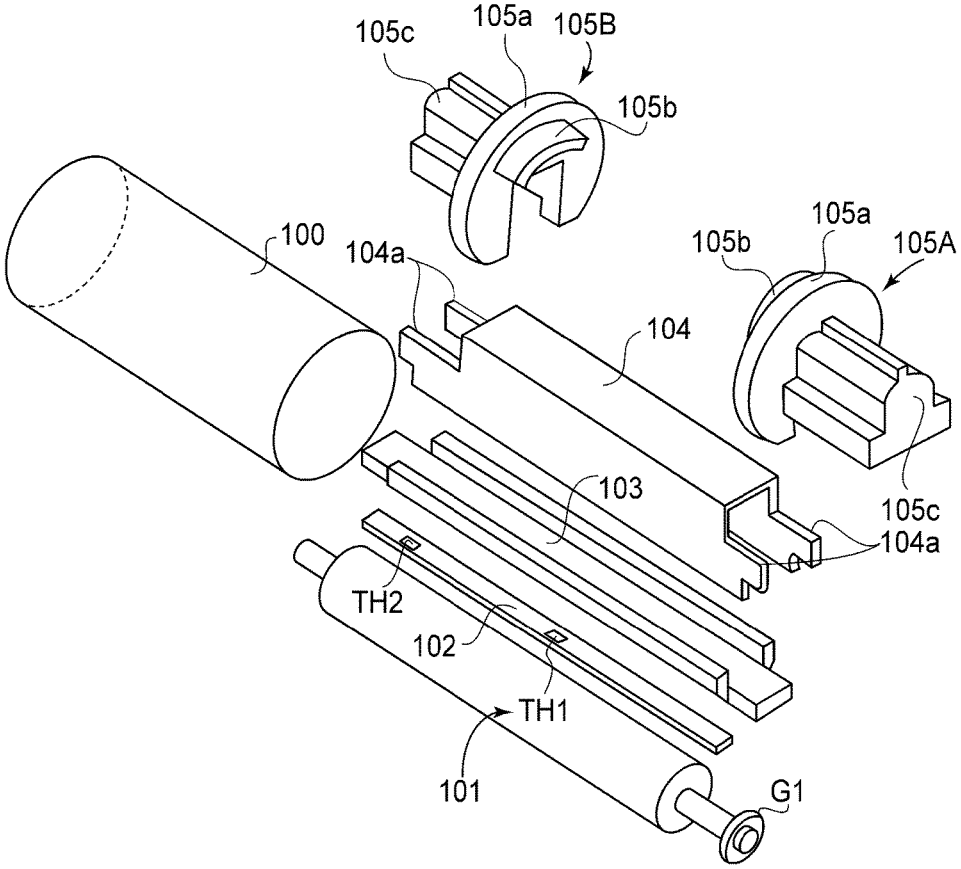
FIG. 8 is an exploded perspective view of the belt unit of the fixing apparatus.

FIG. 8 is an exploded schematic perspective view of the fixation belt unit 110. The fixation belt unit 110 includes the pressure roller 101 as well. The fixation belt unit 110 is an assembly of the cylindrical fixation belt 100, a heater holder 103 (pressure bearing member), a heater 102 (heating member), a pressure bearing stay 104 (belt unit frame), and a pair of flanging members 105A and 105B (belt guide), among other features.

(1) Fixation Belt

The belt 100 is a thin endless belt. The belt 100 is a flexible, heat-resistant, and thermally conductive member. For the purpose of minimizing the belt 100 in thermal capacity to minimize the fixing apparatus 40 in the length of time it takes for the fixing apparatus 40 to start up, the belt 100 was made to be no more than 150 μm in thickness, and such heat-resistant resin, such as polyimide and polyether ether ketone (PEEK) was used as the material for the substrative layer of the belt 100. For electrical conductivity, an electrically conductive substance was dispersed in the material for the substrative layer. Further, for higher thermal conductivity, an elastic layer is formed on the resinous substrative layer, of such a rubbery substance that is high in thermal conductivity. Moreover, a release layer was formed on the elastic layer, of fluorine resin. The resultant belt 100 is an endless belt that is 25 mm in internal diameter.

In this embodiment, the substrative layer of the belt 100 was 30 μm in thickness, and was formed of polyimide. The elastic layer was 70 μm in thickness, and was formed, on the substrative layer, of silicone rubber, which is 1.0 W/m·K in thermal conductivity. The release layer was 30 μm in thickness, and was formed, on the elastic layer, of a piece of perfluoroalkoxy alkane (PFA) tube. The release layer is desired to be in the form of a sheet, or coated layer, of PFA, which is highly slippery. By the way, the belt 100 may be made up of a substrative layer formed of a sheet of a highly heat-resistant substance, such as polyester, polyethylene-terephthalate, and polyimideamide, an electrically conductive layer formed on the substrative layer, and a release layer (surface layer) formed on the electrically conductive layer.

(2) Heater Holder

The heater holder 103 is a nip forming member, by which the heater 102 is supported by being fixed thereto. It is roughly in the form of a trough that is roughly semicircular in cross section. It is disposed in such a manner that its lengthwise direction is parallel to the widthwise direction of the belt 100. It is a thermally insulative member formed of heat-resistant resin, or the like. From the standpoint of energy conservation, the material for the heater holder 103 is desired to be such a substance that can minimize the heater holder 103 in the amount of thermal conduction to the pressure bearing stay 104. For example, a heat-resistant glass, or such a heat-resistant resin as poly-carbonate and liquid polymer can be used.

(3) Heater

The heater 102 is such a heat generating member that is in the shape of a long, narrow, and rectangular piece of plate. The heater 102 is small in thermal capacity. Thus, as the heater 102 is supplied with electrical power, it quickly increases in temperature. In this embodiment, the heater 102 is a ceramic heater. It is made up of a long, narrow, and thin substrate formed of aluminum nitride (AlN), which is excellent in terms of thermal conductivity, and a layer of silver palladium (Ag/Pd), as a heat generating portion, formed on the substrate by a combination of printing and sintering. The heater 102 has also a thin (rough 50 μm to 60 μm in thickness) layer of glass, as a slippery and thermally non-conductive portion, formed on the substrate in a manner to cover the heat generating portion. In this embodiment, a layer of heat generating resistor is formed on the AlN substrate, which is 600 μm in thickness. The heater 102 is held by the heater holder 103 by being fitted in the groove formed in the outwardly facing surface of the heater holder 103, in parallel to the lengthwise direction of the heater holder 103.

On the other hand, there is provided a thermistor TH1 on the opposite surface of the AlN substrate from the surface on which a heating member is present, in order to monitor the temperature of the AlN substrate. The thermistor TH1 is in the form of a chip. More specifically, an electrode pattern is formed in advance by thick film printing, on the opposite surface of the substrate from the surface on which the heating member is present. It is on this electrode pattern that the thermistor TH1 is fixed with adhesive. There is also provided a thermistor TH2 on the opposite surface of the AlN substrate. In terms of the lengthwise direction of the AlN substrate, the thermistor TH2 is disposed on one of the lengthwise end portions of the AlN substrate. In order to enable the thermistors TH1 and TH2 to detect such a temperature level that is greater than the level that the adhesive can withstand, the thermistors TH1 and TH2 are held to the substrate by a preset amount of pressure generated by an unshown pressure applying means, such as a spring.

(4) Pressure Bearing Stay

The pressure bearing stay 104 is a rigid member for bearing the reaction force from the pressure roller 101. The pressure bearing stay 104 is disposed so that it extends in the widthwise direction of the belt 100. The pressure bearing stay 104 is desired to be formed of such a substance that is unlikely to buckle even under a substantial amount of force. In this embodiment, a piece of channeled steel (SUS304) is used as the material for the pressure bearing stay 104. The pressure bearing stay 104 is disposed on the inward side of the heater holder 103. The pressure bearing stay 104 supports the heater holder 103.

(5) Flanging Members

The belt 100 is loosely fitted around the abovementioned assembly of the heater holder 103, the heater 102, and the pressure bearing stay 104. The lengthwise end portions 104*a* of the pressure bearing stay 104 extend beyond the edges of the belt 100. Further, the lengthwise end portions 104*a* of the pressure bearing stay 104 are fitted with a pair of flanging members 105A and 105B. The belt 100 is provided between a flange portion 105*a* of the flanging member 105A, and a flange portion 105*a* of the flanging member 105B, which oppose each other. The flanging members 105A and 105B are regulating members for regulating movement of the belt 100 in the widthwise direction, and also, for regulating the shape of the belt 100 at a plane perpendicular to the lengthwise direction.

The flanging members 105A and 105B are molded of heat-resistant resin, such as polyphenylene sulfide (PPS), liquid polymer, and phenol resin. They each have the flange portion 105*a* (collar portion), a ledge portion 105*b*, and a pressure bearing portion 105*c*.

The flange portion 105*a* is a portion of the flanging portion 105 that regulates movement of the belt 100 in the thrust direction of the belt 100, by catching the belt 100 by the edge of the belt 100. The flange portion 105*a* has such a shape and a size that, after the fixation belt unit 110 is assembled, the contour of the flange portion 105*a* at a plane perpendicular to the lengthwise direction of the fixing apparatus 40 is on the outward side of the contour of the belt 100. The ledge portion 105*b* is in the form of an arc, and perpendicularly protrudes inward of the fixation belt unit 110 from the inward surface of the flange portion 105*a* (105*b*). The ledge portion 105*b* holds the corresponding lengthwise end portion of the belt 100 by the inward surface of the belt 100, to keep the belt 100 cylindrical. The pressure bearing portion 105*c* protrudes from the outward surface of the flange portion 105*a*. The pressure bearing portion 105*c* bears the pressure applied to the flanging portions 105 by one of a pair of pressure application mechanisms 118A and 118B, which will be described later.

(6) Pressure Roller

The pressure roller 101 is made up of a cylindrical metallic core 101*a*, an elastic layer 101*b*, and a surface layer 101*c*. The metallic core 101*a* is made of iron, aluminum, or a like metallic substance. The elastic layer is formed of a soft and rubbery substance, such as sponge or silicone rubber, on the peripheral surface of the metallic core 101*a*. The surface layer 101*c* is a release layer, and is formed of PFA.

In this embodiment, the pressure roller 101 is formed in the following manner. First, the peripheral surface of the metallic core 101*a*, formed of iron, aluminum, or the like, is roughened by blasting, or a like process. Then, it is washed clean, and inserted into a cylindrical mold. Then, liquid silicone rubber is poured into the mold, and is thermally hardened to yield the elastic layer 101*b*. Prior to the pouring of the liquid silicone rubber, a piece of tube, which is made of such resin as PFA, and the inward surface of which has been coated with primer, is inserted into the mold, in order to form the release layer 101*c*. Thus, the tube becomes adhered to the elastic layer 101*b* at the same time that the material for the elastic layer 101*b* is thermally cured. Then, the molded pressure roller 101 is removed from the mold, and is vulcanized (secondary vulcanization).

In this embodiment, the diameter of the metallic core 101*a* of the pressure roller 101 is 15 mm. The elastic layer 101*b* was made of silicone rubber. The thickness of the elastic layer 101*b* was 5 mm, and was 64° in Asker hardness scale. The release layer was made of a piece of PFA tube, and its thickness was 50 μm. The external diameter of the pressure roller 101 was roughly 25 mm.

The pressure roller 101 is rotatably supported between side plates 116A and 116B of the frame 115 of the fixing apparatus 40. More specifically, the lengthwise end portions of the metallic core 101*a* are rotatably supported by a pair of bearings 114 attached to the side plates 116A and 116B, respectively.

The fixing belt unit 110 is disposed between the side plates 116A and 116B, practically in parallel to the pressure roller 101, in such an attitude that its heater side faces the pressure roller 101. Each of the pressure bearing portions 105*c* of the flanging members 105A and 105B is fitted in a corresponding guiding hole 117 provided on the side wall 116A (116B), so that the pressure bearing portions 105*c* are allowed to slide toward, or away from, the pressure roller 101.

The flanging members 105A and 105B remain under a preset amount of pressure (nip formation pressure) generated by the pair of pressure application mechanisms 118A and 118B (that will be described later), in the direction of the pressure roller 101. In this embodiment, 150 N of pressure was applied to each of the pressure bearing portions 105*c*. Thus, the total amount of pressure applied to the pair of flanging members 105A and 105B was 300 N.

With the presence of this pressure applied by the pressure application mechanisms 118A and 118B, the entirety of the combination of the flanging members 105A and 105B, pressure bearing stay 104 and the heater holder 103 of the fixation belt unit 110 is pressed toward the pressure roller 101. Therefore, the heater holder 103 and the heater 102 are pressed against a combination of the resiliency of the elastic layer of the belt 100, and that of the elastic layer of the pressure roller 101. Thus, a nip N, which has a preset width in terms of the recording paper conveyance direction X (recording medium conveyance direction), is formed between the belt 100 and the pressure roller 101.

(7) Fixing Operation

One of the end portions of the metallic core 101*a* of the pressure roller 101 is concentrically fitted with a driving gear G1. A driving force from a fixation motor 92 (driving force source, or simply, motor), which is under the control of the CPU 810 (FIG. 12), is transmitted to the driving gear G1 by way of a driving force transmitting mechanism portion of a fixing apparatus driving portion 90 (FIG. 4). In this embodiment, the motor 92 is driven in the counterclockwise direction indicated by an arrow mark Y, and the driving force from the motor 92 is transmitted to the gear G1 by way of the driving force transmitting portion of the fixing apparatus driving portion 90. Thus, the pressure roller 101, which is a rotationally drivable member, is rotated in the clockwise direction, indicated by an arrow mark R101 in FIG. 7, at a preset velocity.

As the pressure roller 101 is rotationally driven, the belt 100 is subjected to a rotational force (torque) generated by the friction between the belt 100 and the pressure roller 101 in the nip N. Thus, the belt 100 rotates around the combination of the heater holder 103 and the heater 102, in the counterclockwise direction indicated by an arrow mark R100 in FIG. 7, with its inward surface sliding on the heater 102, and a part of the heater holder 103, in the nip N. The rotational speed of the belt 100 is roughly the same as the peripheral velocity of the pressure roller 101.

In order to minimize the amount of friction between the belt 100 and the combination of the heater 102 and the heater holder 103, the inward surface of the belt 100, the surface of the heater 102 on which the belt 100 slides, and the surface of the heater holder 103 on which the belt 100 slides, are coated in advance with a lubricant (unshown). In this embodiment, the lubricant was oil, which is desired to be silicone oil, or the like, which can be used in an environment that is high in temperature.

The CPU 810 starts supplying electrical power to the heater 102 from a power supplying portion (unshown). The route through which power is supplied from the power supplying portion to the heater 102 is not shown in the drawings. The power is supplied to the heater 102, however, through a combination of wiring and connectors provided for establishing an electrical connection between the power supplying portion and the heater 102. As the heater 102 is supplied with electrical power, it quickly increases in temperature. The thermistor TH1 outputs signals, which reflect the temperature of the heater 102, to the CPU 810. The CPU 810 controls the amount by which electrical power is supplied to the heater 100 from the power supplying portion, according to the heater temperature detected by the thermistor TH1, so that the heater temperature increases to a preset target level and remains at the target level.

As the fixing apparatus 40 was increased in temperature, and kept in the state described above, a sheet P of recording medium, on which an unfixed toner image T has just been formed, is introduced into the fixing apparatus 40 from the image forming portion 10. Then, the sheet P is conveyed through the nip N while remaining pinched between the belt 100 and the pressure roller 101. While the sheet P is conveyed through the nip N, the heat from the heater 102 is given to the sheet P and to the unfixed toner image T thereon through the belt 100. Thus, the unfixed toner image T is melted by the heat from the heater 102, and is fixed to the sheet P by the pressure to which the nip N is being subjected.

Pressure Application Mechanism

The fixing apparatus 40 is provided with the pair of pressure application mechanisms 118A and 118B, which are on the outward side of the side plates 116A and 116B of the frame 115 of the fixing apparatus 40, respectively. The two pressure application mechanisms 118A and 118B are symmetrically disposed with reference to the center of the fixing apparatus 40 in terms of the lengthwise direction of the apparatus 40. Further, they are the same in structure. Therefore, only the pressure application mechanism 118A, that is, the one shown in FIG. 5, is described as the one that represents both the pressure application mechanisms 118A and 118B.

The pressure application mechanism 118A has a pressure lever 112 and a compression spring 113. The pressure lever 112 is attached to the side plate 116A by its base side in such a manner that it can be pivotally moved about a shaft portion 111. The pressure lever 112 extends from the shaft portion 111 toward and beyond the pressure bearing portion 105*c* of the flanging member 105A. The compression spring 113 is an elastic member that generates such pressure that keeps the pressure lever 112 pressed in the direction to make the pressure lever 112 contact and press the pressure bearing portion 105*c* of the flanging member 105A.

In this embodiment, a part of the pressure lever 112, which is on the opposite side of the shaft portion 111 from the pressure bearing portion 105*c*, is provided with a through hole (unshown), through which a long pressure adjustment screw 132 is put. The leading end portion of the pressure adjustment screw 132, in terms of the direction in which the screw 132 is put through the through hole, is fitted in (screwed into) the screw hole 133, with which the slide plate 116A is provided. It is around this screw 132 that the compression spring 113, which is in the form of a coil, is fitted between a head portion 132*a* (spring seating surface) of this screw 132 and the pressure lever 112. Therefore, when the pressure lever 112 is not under any force except for the pressure from the compression spring 113, it is made, by the resiliency of the compression spring 113, to be in contact with, and to press on, the pressure bearing portion 105*c* of the flanging member 105A.

As the screw 132 is turned in the direction to be tightened, the head portion 132*a* of the screw 132 moves in the direction to reduce the compression spring 113 in length, increasing, thereby, the compression spring 113 in the amount of pressure it generates. That is, the amount of pressure to be applied to the pressure lever 112 can be adjusted by turning the screw 132. Since the pressure lever 112 is rotatably supported by the side plate 116A, the pressure lever 112 is subjected to the moment generated by the resiliency of the compression spring 113 in a manner to rotate the pressure lever 112 about the shaft portion 111. Thus, the flanging member 105A remains pressed toward the pressure roller 102 by a preset amount of pressure.

In the foregoing, the pressure application mechanism 118A, that is, one of the pair of pressure application mechanisms, was described. The other pressure application mechanism 118B, shown in FIG. 6, is the same in structure as the pressure application mechanism 118A.

(9) Pressure Removal Mechanism

The pressure applied by the pressure application mechanisms 118A and 118B, which are disposed at the lengthwise ends of the fixing apparatus 40, one for one, is removable by the pressure removal mechanism 119. In this embodiment, the pressure removal mechanism 119 has a pair of cams 120 attached to the lengthwise ends of a camshaft 123, one for one, for pivotally moving the pressure lever 112 of the pressure application mechanisms 118A and 118B, respectively. Referring to FIGS. 4 to 6, in terms of the widthwise direction of the fixation belt 100, each of the pair of cams 120 is disposed on the outward side of the side plates 116A and 116B, one for one.

The two cams 120 are the same in shape, and also, in the amount of eccentricity. They are attached to the lengthwise end portions of the camshaft 123 (rotational axle), one for one. The camshaft 123 is rotatably supported between the side plates 116A and 116B, by the side plates 116A and 116B, with the placement of a pair of bearings 131 and 131 (shaft bearing portions) between the camshaft 123 and the side plates 116, one for one. Further, the cams 120 are attached to the camshaft 123 in such a manner that, as they are seen from the direction parallel to the camshaft 123, the contour of one cam 120 coincides with that of the other. Thus, the cams 120 rotate with the camshaft 123. In terms of the recording medium conveyance direction, each cam 120 corresponds in position to the downstream end portion of the pressure lever 112.

One of the lengthwise end portions of the camshaft 123 is concentrically fitted with a cam gear 121 (pressure removal gear) (FIG. 4). A driving force from the motor 92, which is under the control of the CPU 810, is transmitted to the cam gear 121 by way of the driving force transmission mechanism portion of a cam driving portion 91. By the way, the cam gear 121, the motor 92, the fixation apparatus driving portion 90, and the cam driving portion 91, which are shown in FIG. 4, are not shown in FIG. 5.

The inside of the fixing apparatus driving portion 90, and the inside of the cam driving portion 91 are provided with a one-way clutch (unshown). Thus, as the motor 92 is rotated in the clockwise direction (normal direction) indicated by the arrow mark Y, the driving force from the motor 91 is transmitted to only the pressure roller 101, i.e., it is not transmitted to the cam gear 121. On the other hand, if the motor 92 is rotated in the counterclockwise direction (in reverse) indicated by an arrow mark V, the driving force from the motor 91 is transmitted to only the cam gear 121, i.e., it is not transmitted to the pressure roller 101.

In an ordinary image forming operation, the motor 92 is rotated in the direction indicated by the arrow mark Y to transmit the driving force to the pressure roller 101, in order to convey a sheet P of recording medium to fix a toner image T on the sheet P. On the other hand, when it is necessary to allow the pressure from the compression springs 113 to act on the fixation belt unit 110 or to cancel the pressure applied to the fixation belt unit 110 from the compression springs 113, the motor 92 is rotated in the direction indicated by the arrow mark V to transmit the driving force to the cam gear 121, in order to rotate the cams 120 (camshaft 123). In this embodiment, a combination of the motor 92, the cam driving portion 91, and the cam gear 121 makes up the driving mechanism that drives the combination of the camshaft 123 and the cams 120, which make up the pressure removal mechanism 119.

Part (a) of FIG. 9 is a sectional view of the portion of the fixing apparatus 40, which is related to the present invention, when the fixation belt unit 110 is under a preset amount of pressure, and, therefore, the nip N having a preset width in terms of the recording medium conveyance direction X, is formed between the belt 100 and the pressure roller 101. When the fixing apparatus 40 is in the state shown in part (a) of FIG. 9, the cams 120, which are attached to the lengthwise end portions of the pressure removal mechanism 119, one for one, are in such an angle that the portion of each cam 120, which is the smallest in radius, faces the corresponding pressure lever 112 of the pressure application mechanism 118A or 118B. In other words, the cam 120 is not in contact with the pressure lever 112.

That is, the pressure lever 112 is free from the cam 120. Therefore, the flanging members 105A and 105B come under the pressure from the combination of the compression spring 113 and the pressure lever 112 of the pressure application mechanisms 118A and 118B, at the lengthwise ends of the fixing apparatus 40, respectively. Thus the fixing apparatus 40 is kept in a state in which the belt 100 and the pressure roller 101 are kept pressed against each other, and, therefore, the nip N having the preset width between is formed the belt 100 and the pressure roller 101.

Part (b) of FIG. 9 shows the state of the aforementioned essential portion of the fixing apparatus 40, which is related to the present invention, when the pressure applied to the fixation belt unit 110 from the compression springs 113 is being cancelled. As the reversal driving force from the fixation motor 92 is transmitted to the cam gear 121 by way of the driving force transmitting mechanism portion of the cam driving portion 91 when the fixing apparatus 40 is in the state shown in part (a) of FIG. 9, that is, when the pressure lever 112 is free from the cam 120, the camshaft 123 is rotated. As the camshaft 123 is rotated, the two cams 120 attached to the lengthwise end portions of the camshaft 123, one for one, rotate together remaining at the same in angle, until the portion of each cam 120, which is the largest in radius, opposes the pressure lever 112.

Thus, the pressure lever 112 is pressed by the cam 120 in the direction to be separated from the pressure bearing portion 105*c* of the flanging member 105A (or 105B), against the resiliency of the compression spring 113. Consequently, the fixation belt 100 and the pressure roller 101 are freed from the pressure that kept them pressed against each other.

(10) Control Sequence for Cancelling Pressure from Compression Springs

FIG. 10 is a flowchart of the control sequence for cancelling the pressure from the compression springs 113. FIG. 11 is a flowchart of the control sequence for allowing the pressure from the compression springs 113 to act on the fixation belt unit 110. As described above, as the camshaft 123 is driven by the cam driving portion 91, the pressure levers 112 are pivotally moved by the cams 120. Thus, the belt 100 and the pressure roller 101 are freed from the pressure that kept them pressed against each other.

This pressure removal operation is carried out to improve the fixing apparatus 40 in terms of the efficiency with which a sheet P of recording medium, having become stuck in the nip N while the sheet P is conveyed, can be removed. The pressure removal operation is also carried out for the following reason. That is, if the fixing apparatus 40 is not driven for a substantial length of time while the belt 100 is kept pressed upon the pressure roller 101, the belt 100 and/or the pressure roller 101 sometimes suffer from scars attributable to the compression. This is why the pressure applied to the fixation belt unit 110 from the compression springs 113 is cancelled when the fixing apparatus 40 is not in use.

The pair of cams 120 are attached to the lengthwise end portion of the camshaft 123. The cam gear 121 is coaxially attached to one of the lengthwise ends of the camshaft 123. The cam gear 121 is provided with a flag 121*a*, which is an integral part of the gear 121. It rotates in synchronism with the cams 120. Thus, the cam angle in terms of the rotational direction of the cam 120 can be detected by a separation sensor 122. The separation sensor 122 is structured so that a beam of infrared light is projected from one end of its internal space of the sensor 122 to the other, and also, so that as the flag 121*a* blocks or unblocks the beam passage, the sensor 122 transmits a signal.

The operation for changing, in state, the combination of the pressure application mechanisms 118A and 118B, from the state shown in part (a) of FIG. 9 to the state shown in part (b) of FIG. 9, is as follows. Referring to the flowchart in FIG. 10, first, a pressure cancelling command signal is issued from the engine controller 802 of the control portion 800 (S01). As the signal is issued, the CPU 810 (ENG) stops the fixation motor 92 of the fixing apparatus driving portion 90. Then, the CPU 810 makes the fixation motor 92 (fixation motor M) rotate in the direction indicated by the arrow mark V (FIG. 4) (S02), to cause the cams 120 to be rotated in the direction indicated by an arrow mark W (FIG. 9) by the driving force transmitted thereto by way of the driving force transmission mechanism of the cam driving portion 92.

Thus, the flag 121*a*, which is an integral part of the cam gear 121 coaxially attached to the camshaft 123, rotates at the same time as the cam 121.

Until the flag 121*a* begins to rotate, the separation sensor 122 is in such a state that the beam of infrared light is not blocked. As the flag 121*a* rotates, however, it enters the passage of the beam of infrared light, and, therefore, the beam is blocked (S03). The timing with which the beam passage becomes completely blocked is synchronous with the timing with which the cam 120 finishes cancelling the pressure from the compression springs 113. As the output signal from the separation sensor 122 changes, the CPU 810 determines that the pressure applied to the fixation belt unit 110 from the compression springs 113 is being cancelled. Then, it stops the fixation motor 92 (S04), ending the operation for cancelling the pressure from the compression springs 113 (S05).

The pressure cancelling command signal is outputted from the engine controller 802 as the occurrence of paper jam is detected by the sheet detection sensor, the opening of the door 26 is detected, or the copying machine A is placed in the low power mode (economy mode).

The operation for applying pressure to the fixation belt unit 110 to cause the fixation belt 100 and the pressure roller 101 to be pressed upon each other is as follows. Referring to FIG. 11, which is a flowchart of the control sequence for causing the belt 100 to be pressed upon the pressure roller 101, as a pressure activation command signal is issued from the engine controller 802 of the control portion 800 (S11), the operation for pressing the belt 100 upon the pressure roller 101 is started. First, the CPU 810 (ENG) rotationally drives the fixation motor 92 in the direction indicated by the arrow mark V (S12). Thus, the cam gear 121 begins to be rotated in the direction indicated by the arrow mark W by the driving force transmitted thereto though the driving force transmission mechanism of the driving portion 92. Thus, the cams 120, which are coaxially attached to the camshaft 123, rotate with the camshaft 123.

While the pressure is removed from the fixation belt unit 110, the flag 121*a*, which is an integral part of the cam gear 121, continuously blocks the beam of infrared light. That is, while the cam gear 121 rotates, the flag 121*a* continuously blocks the beam of infrared light. As the cam gear 121 is rotated enough to completely remove the pressure from the fixation belt unit 110, the flag 121*a* moves past the infrared beam passage, allowing thereby the beam to reach the beam receptor of the separation sensor 122 (S13). Thus, the separation sensor 122 changes in output signal. Therefore, the engine controller 802 determines that the nip N is under pressure. Thus, it stops the fixation motor 92 (S14), ending the operation for applying pressure to the fixation belt unit 110 to keep the belt 100 pressed upon the pressure roller 101 (S15).

The pressure activation command signal is issued from the engine controller 802 as the copying machine A is put in the image formation mode and becomes ready for image formation. That the copying machine A is ready for image formation means that the copying machine A is in such a state that, as the copy button (key) is pressed, or an image formation start signal is inputted from such an external device as a personal computer (PC), the copying machine A can immediately start forming an image.

(11) In a case in which a fixing apparatus is structured so that, as the pressure levers 112 are pushed up against the resiliency of the compression springs 113 by the cams 120 for preventing the camshaft 123 from bowing, the cams 120 attached to the lengthwise end portions of the camshaft 123, one for one, are subjected to the force (load) that is generated by the compressions spring 113 and applied to the cams 123 by way of the pressure levers 112. Referring to FIGS. 4 to 6, in terms of the widthwise direction of the fixing apparatus 40, the cams 120 are on the outward side of the side plates 116A and 116B, that is, on the outward side of the bearings 131, respectively. Therefore, it is possible that when the pressure levers 112 are not under the pressure from the compression springs 113, the camshaft 123 will be made to bow, by the load to which the cams 120 are subjected, in such a manner that the portion of the camshaft 123, which is between the two bearings 120*a*, bows in such a manner that its center portion moves upward, whereas, the portions of the camshaft 123 on the outward sides of the bearings 120, one for one, tilt downward. In particular, in a case in which the compression springs 113 are increased in resiliency, and/or a fixing apparatus is structured to increase the amount by which a force is applied to the cams 120 by the compression springs 113, in order to improve a fixing apparatus (image forming apparatus) in image quality, the amount of the load to which the cams 120 are subjected is substantial. Therefore, it is possible that the cam gear 121, which is a part of the driving system that is in connection to the cams 120 will fail to properly drive the camshaft 123, and the cam gear 121 will momentarily skip (disengage from the counterpart). In this embodiment, therefore, the fixing apparatus 40 is provided with a regulating portion for preventing the problem that the camshaft 123 bows when the pressure applied to the fixation belt unit 110 from the compression springs 113 is being cancelled. In terms of the widthwise direction of the fixation belt 100, the regulating portion is positioned on the inward side of the side plates 116A and 116B, that is, on the inward side of the bearings 131. Thus, all that is required of the regulating portion is that it is structured to prevent the camshaft 123 from bowing.

Hereafter, an example of structural arrangement for preventing the bowing of the camshaft 123 is described in detail with reference to appended drawings.

Figure 1:
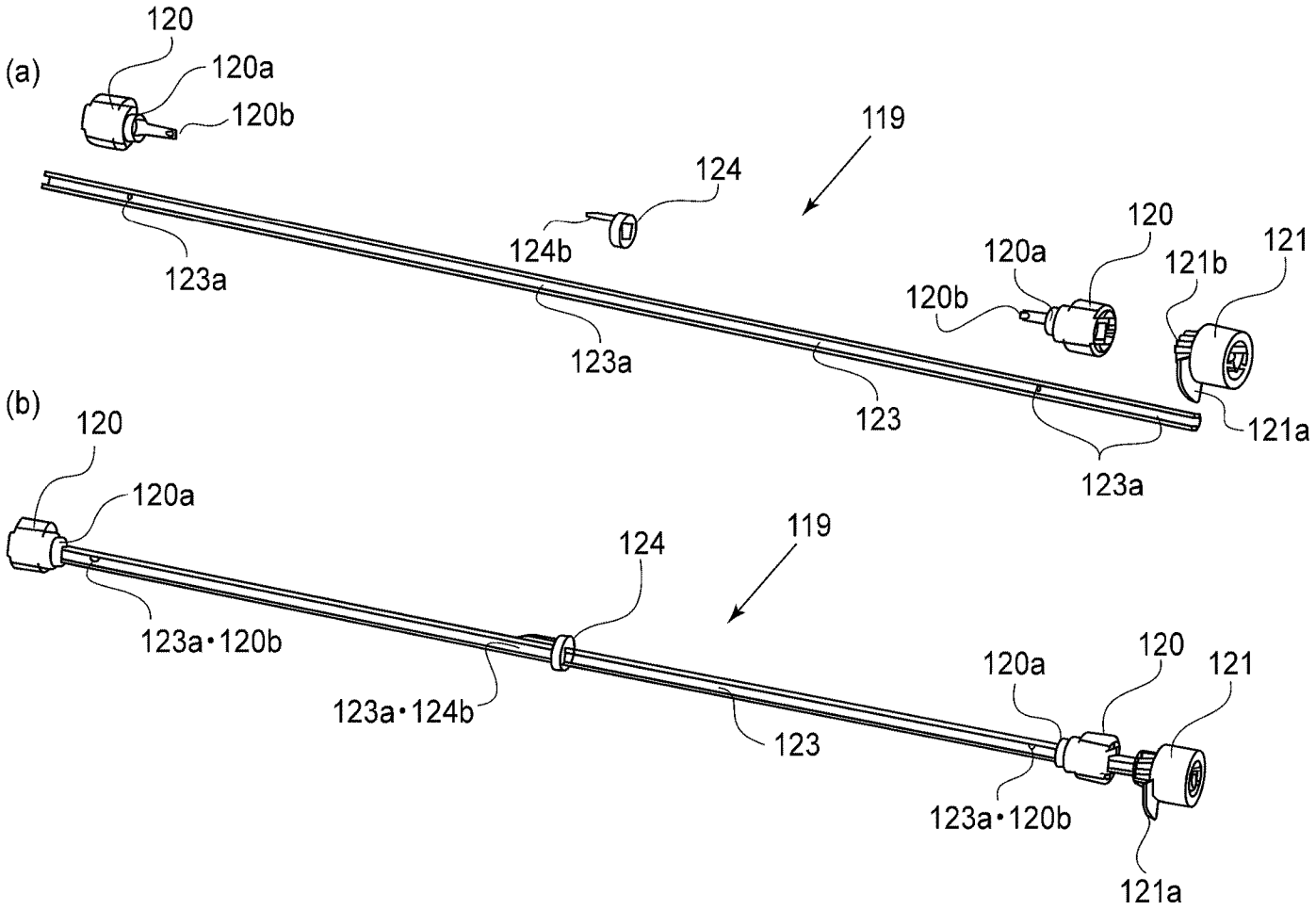

To begin with, referring to parts (a) and (b) of FIG. 1, and FIGS. 13 and 14, the structure of the pressure removal mechanism 119, which characterizes this embodiment, is described. Part (a) of FIG. 1 is an exploded perspective view of the pressure removal mechanism 119. It shows the structural components (members) of the mechanism 119. Part (b) of FIG. 1 is a perspective view of the assembled pressure removal mechanism 119.

In this embodiment, a piece of channeled rod, which is square in cross section (perpendicular to lengthwise direction) is used as the camshaft 123. More concretely, a piece of channeled metallic rod (channeled rod made by bending metallic plate), which is U-shaped (FIG. 9) in cross section, is used as the camshaft 123. In this embodiment, a piece of steel plate electrically plated with zinc, which is 0.8 mm in thickness, is used as the material for the camshaft 123. Using a piece of channeled metallic rod formed by bending a thin piece of metallic plate so that the resultant product will become U-shaped in cross section can substantially reduce the camshaft 123 in cost compared to using a piece of steel rod that is circular in cross section.

The camshaft 123 is provided with the cam gear 121 and the pair of cams 120. The cam gear 121 is attached to one of the lengthwise end portions of the camshaft 123. As for the cams 120, they are attached to the lengthwise end portions of the camshaft 123, one for one. More specifically, one of them is attached to one of the lengthwise ends of the camshaft 123, whereas the other is attached to the slightly inward portion of the camshaft 123 from the cam gear 120.

The two cams 120 are eccentric and are the same in the amount of eccentricity. They are attached to the camshaft 123 in such a manner that they become the same in rotational phase. The two cams 120 rotate with the camshaft 123.

Further, the camshaft 123 is fitted with a roller 124 (slippery member, second regulating member). The roller 124 is made of a resinous substance, and is positioned right in the middle of the two cams 120. In this embodiment, polyamide (PA) (nylon) was used as the material for the roller 124. More specifically, in terms of the widthwise direction of the fixation belt 100, the portion of the camshaft 123, which is between the pair of bearings 131, is provided with the roller 124.

Each of the pair of cams 120 is provided with a springy (flexible) protrusion 120*b*. The roller 124 is provided with a springy (flexible) protrusion 124*b*. The cams 120 and the roller 124 are fitted around the camshaft 123. As they are fitted around the camshaft 123, their springy (flexible) protrusions 120*b*, 120*b* and 124*b* fit into three holes 123*a*, one for one, with which the camshaft 123 is provided. Thus, the cams 120 and the roller 124 remain attached to the preset portions of the camshaft 123, one for one.

Each of the pair of cams 120 is provided with a camshaft bearing 120*a*, which is fitted into the camshaft hole (bearing portion, unshown) with which the side plate 116A (116B) is provided. Thus, the camshaft 123 is rotatably supported between the side plates 116A and 116B. That is, in terms of the lengthwise direction of the fixing apparatus 40, the camshaft 123, which is a rotational shaft, is supported by a pair of bearings, which are near the lengthwise ends of the camshaft 123, one for one. As for the pair of cams 120, one of them is attached to one of the lengthwise ends of the camshaft 123, whereas the other is attached to a portion of the camshaft 123, which is adjacent to the other end of the camshaft 123.

FIG. 13 is a perspective view of the fixing apparatus 40 in this embodiment, when the belt 100 is pressed upon the pressure roller 101. FIG. 14 is a perspective view of the fixing apparatus 40 in this embodiment, when the fixation belt unit 110 is free from the pressure from the compression springs 113. A metallic stay 125 is provided between the side plates 116A and 116B, which are at the lengthwise ends of the frame 115 of the fixing apparatus 40, one for one, in order to increase the frame 115 in rigidity.

Referring to FIG. 13, the center portion of the stay 125, in terms of the lengthwise direction of the stay 125, is provided with a regulating portion 125*a*, which is protrusive toward the camshaft 123. Also in terms of the lengthwise direction, the regulating portion 125*a* is sized and positioned so that the distance between the regulating surface of the regulating portion 125*a* and the peripheral surface of the roller 124 is very small (virtually zero). In this embodiment, the distance between the peripheral surface of the roller 124 and the regulating surface of the regulating portion 125*a* is 0.1 mm.

The roller 124 described above is such a slippery cylindrical member that is coaxially fitted around the camshaft 123, and also, rotates with the camshaft 123. It is desired that the fixing apparatus 40 is provided at least one roller (124). The regulating portion 125*a* is sized and positioned so that the distance between the peripheral surface of the roller 124 (slippery member) and the regulating surface of the regulating portion 125*a* is zero or virtually zero.

As the fixing apparatus 40 is changed in state from the state shown in FIG. 13, in which the fixation belt 100 is pressed upon the pressure roller 101, to the state shown in FIG. 14, in which the fixation belt 100 is not being pressed upon the pressure roller 101, through the pressure removal sequence shown in FIG. 10, the pair of cams 120, which are attached to one of the lengthwise ends of the camshaft 123, and the portion of the camshaft 123, which is adjacent to the other lengthwise end, one for one, are pressed in the direction indicated by the arrow mark A by the corresponding cams 120, one for one. As the cams 120 are pressed by the pressure application levers 112, the camshaft 123 is made to bend in such a manner that the portion of the camshaft 123, which is between the pair of camshaft bearings 120*a*, bows in such a manner that its center portion moves upward (toward stay 125), whereas the portions of the camshaft 123, which are on the outward side of the bearings 120*a*, tilt downward. In this embodiment, however, as the camshaft 123 begins to be bend (made to bow), the peripheral surface of the roller 124 comes into contact with the regulating surface of the regulating portion 125*a*. Thus, the camshaft 123 is minimized in the amount of bending (bowing).

Therefore, the distance between the cam gear 121 and the cam driving portion 91 is kept stable. Therefore, it does not occur that the cam gear 21 skips (momentarily disengages from counterpart), and, therefore, the driving force is reliably transmitted.

Further, in a case in which a camshaft that is not circular in the cross section perpendicular to its lengthwise direction, for example, a camshaft, like the camshaft 123 in this embodiment, is employed, it is desired that the camshaft is fitted with a roller, such as the roller 124. With the camshaft being fitted with a roller, like the roller 124, even if the camshaft (123) bows, and, therefore, the roller (124) comes into contact with the regulating surface of the regulating portion 125*a*, the contact is unlikely to interfere with the rotation of the camshaft (123). In addition, the roller 124 is formed of a resinous substance (outermost layer of roller is formed of resin). Therefore, the camshaft 123 can smoothly rotate even while roller 124 is in contact with the regulating portion 125*a*.

As described above, in this embodiment, the center portion of the camshaft 123 of the pressure removal mechanism 119 is provided with the slippery member 124. Further, the fixing apparatus 40 is structured so that the distance between the stay 125 of its frame 115 and the slippery member 124 is zero or virtually zero. Therefore, it is possible to prevent the camshaft 123 from bending (bowing), even though the fixing apparatus 40 was increased in the fixation pressure in order to increase the apparatus 40 in speed. That is, this embodiment can prevent the problem that the fixing apparatus 40 malfunctions due to gear tooth skipping of the pressure removal gear 121 that occurs during the pressure removal operation.

In this embodiment, the distance between the peripheral surface of the roller 124 and the regulating surface of the regulating portion 125*a* was set to virtually zero (0.1 mm in this embodiment). The fixing apparatus 40 may be structured, however, so that the peripheral surface of the roller 124 remains in contact with the regulating surface of the regulating portion 125*a* (distance is zero).

Further, in this embodiment, the fixing apparatus 40 is structured so that it is provided with only a single combination of the roller 124 and the regulating portion 125*a*, and also, so that the position of the combination coincides with the center of the camshaft 123 in terms of the lengthwise direction of the fixing apparatus 40. As long as the camshaft 123 can be prevented from bending (bowing), however, the positioning of the combination of the roller 124 and the regulating portion 125*a*, relative to the camshaft 123 may be anywhere. Further, it is not mandatory that the fixing apparatus 40 is provided with only a single combination of the roller 124 and the regulating portion 125*a*. That is, the fixing apparatus 40 may be provided with two or more combinations of rollers 124 and the regulating portion 125*a*. In other words, all that is necessary is that the fixing apparatus 40 is provided with at least one combination of the roller 124, and the regulating portion 125*a*, as a regulating portion, and also, that the combination is positioned between the two portions of the camshaft 123 (rotational shaft), at which the camshaft 123 is supported by a pair of bearings, one for one.

Embodiment 2

Next, referring to FIGS. 15 and 16, the second embodiment of the present invention is described. The structural features of the image heating apparatus in this embodiment that are the same as those in the first embodiment are not described.

In the first embodiment, the fixing apparatus 40 was structured so that it was provided with the stay 125, which is an example of regulating portion, and that extended in the lengthwise direction of the fixing apparatus 40. Further, the center portion of the stay 125 was provided with the regulating portion 125*a*, which was partially protrusive toward the camshaft 123. The fixing apparatus 40 may be structured, however, so that a part of the top sheet discharge guide 126 plays the role of the regulating portion 126*a*, on the top side of the camshaft 123.

FIG. 15 is a perspective view of the fixing apparatus 40 in this embodiment when the fixing apparatus 40 is free of the fixation pressure. For convenience sake, the belt unit 110 is not shown, except for its flanging members. FIG. 16 is a cross-sectional view of the fixing apparatus 40, when the fixing apparatus 40 is free of the fixation pressure (at plane (16)-(16) indicated by arrow marks in FIG. 15). In this embodiment, the copying machine A (image forming apparatus) is provided with a sheet entrance guide 128, which is on the upstream side of the combination of the pressure roller 101 and the belt 100 in terms of the recording medium conveyance direction. Further, the copying machine A is provided with a separation plate 129, a sheet exit guide 130, a pair of intermediary discharge rollers 131, a pair of downstream discharge rollers 132, a top sheet discharge guide 126, and a bottom sheet discharge guide 127, which are on the downstream side of the combination of the pressure roller 101 and the belt 100.

The top sheet discharge guide 126 is formed of a resinous substance. Not only does it have a guiding surface for guiding a sheet P of recording medium, but also, a regulating portion 126*a* (having a regulating surface), which is above the camshaft 123. The regulating portion 126*a* is formed of a resinous substance. In this embodiment, polybutyleneterephthalate (PBT) was used as the material for the sheet discharge top guide 126. The fixing apparatus 40 is structured so that the distance between the peripheral surface of the roller 124 attached to the camshaft 123 and the regulating surface of the regulating portion 126*a* is virtually zero (0.1 mm in this embodiment).

Even after the fixation pressure is removed from the fixation belt unit 110, the pair of cams 120 attached to the lengthwise end portions of the camshaft 123, one for one, remain pressed by the pressure levers 112. That is, the pair of cams 120 remain subjected to the loads generated by the pressure levers 112 in the direction indicated by the arrow mark A, as in the first embodiment. As the cams 120 are subjected to the loads, the portions of the camshaft 123, which are on the outward side of the cam bearings 120*a*, one for one, are subjected to such loads that cause the portions of the camshaft 123, which is between the camshaft bearings 120*a*, to bow in such a manner that a center portion moves in the direction indicated by the arrow mark B.

That is, the camshaft 123 begins to bow as described above. As soon as the camshaft 123 starts to bow, however, the peripheral surface of the roller 124 comes into contact with the regulating surface of the regulating portion 126*a*, preventing thereby the camshaft 123 from bowing further. Thus, virtually no change occurs to the distance between the cam gear 121 and the cam driving portion 91. Therefore, the gear tooth skipping of the cam gear 121 does not occur. For this reason, the driving force is satisfactorily transmitted to the camshaft 123. Further, the roller 124 and the regulating portion 126*a* are made of a resinous substance. Therefore, the friction between the roller 124 and the regulating portion 126*a* is very small. Therefore, the camshaft 123 is allowed to smoothly rotate.

In this embodiment, the fixing apparatus 40 was structured so that the distance between the peripheral surface of the roller 124 and the regulating surface of the regulating portion 126*a* is virtually zero (0.1 mm). The fixing apparatus 40 may be structure, however, so that the peripheral surface of the roller 124 always remains in contact with the regulating surface of the regulating portion 126*a* (distance is zero).

In this embodiment, the fixing apparatus 40 is structured so that it is provided with only a single combination of the roller 124 and the regulating portion 126*a*, and also, so that the position of the combination coincides with the center of the camshaft 123 in terms of the lengthwise direction of the fixing apparatus 40. As long as the camshaft 123 can be prevented from bending (bowing), however, the positioning of the combination of the roller 124 and the regulating portion 126*a*, relative to the camshaft 123, may be anywhere. Further, it is not mandatory that the fixing apparatus 40 is provided with only a single combination of the roller 124 and the regulating portion 126*a*. That is, the fixing apparatus 40 may be provided with two or more combinations of rollers 124 and the regulating portion 126*a*.

In this embodiment, the fixing apparatus 40 employs an endless and rotatable member (belt) as a heating member, and a roller as a pressure applying member. Further, the endless and rotatable member is not suspended, nor tensioned. The preceding embodiments are not, however, intended to limit the present invention in scope in terms of the fixing method. For example, the present invention is also applicable to fixing apparatuses that employ such a fixing method that employs an endless rotational member (belt) in place of a pressure roller, and a suspended and tensioned endless rotatable member as a heating member.

Miscellanies (1) Regarding the state of the fixing apparatus 40 in which the belt 100 is not pressed upon the pressure roller 101, as shown in part (b) of FIG. 9, the belt 100 may be kept pressed upon the pressure roller 101 as long as the pressure applied to keep the belt 100 pressed upon the pressure roller 101 is small enough to leave no compression scar on the belt 100 and/or the pressure roller 101. That is, the pressure removal mechanism, which includes the cams 120, may be structured so that when it is unnecessary for the belt 100 and the pressure roller 101 to be pressed upon each other, the belt 100 and the pressure roller 101 are kept separated from each other, or the pressure for keeping the belt 100 and the pressure roller 101 pressed upon each other to form the nip N is reduced to a preset small value (substantially smaller than value of pressure applied by the pressure application mechanism to form the nip N for image fixation).

(2) In the preceding embodiments described above, the fixing apparatus 40 is for fixing an unfixed toner image T formed on a sheet P of recording paper to the sheet, by heating the toner image T. The two embodiments are not, however, intended to limit the present invention in scope in terms of the type of a fixing apparatus to which the present invention is applicable. For example, the present invention is also applicable to an apparatus (that also is referred to as fixing apparatus) for heating, for the second time, a toner image that was temporarily fixed to a sheet P of recording paper, in order to increase the image in gloss.

(3) The preceding embodiments are not intended to limit the present invention in scope in terms of the heating member for heating the belt 100. That is, the application of the present invention is not limited to a fixing apparatus that uses a ceramic heater, such as the heater 102 in the preceding embodiments. That is, the present invention is also compatible with a fixing apparatus that employs an internal heating member, an external heating member, a heating member based on electromagnetic induction, a halogen heater, an infrared lamp, a nickel-chrome wire heater, etc. Further, the present invention is also applicable to fixing apparatuses having a pressure roller 101 that is provided with a heating member for heating the roller 101.

(4) The present invention is also applicable to fixing apparatuses in which one of the pair of rotational members is an endless belt, and the other is a roller. Further, it is also applicable to fixing apparatuses in which both of the pair of rotational members are endless belts, or both of the pair of rotational members are rollers. Further, in the preceding embodiments, both of the rotational members, that is, both the belt 100 and the pressure roller 101, had an elastic layer. The present invention is also applicable, however, to fixing apparatuses in which only one of the pair of rotational members has an elastic layer.

(5) The selection of image forming apparatuses to which the present invention is applicable is not limited to a full-color image forming apparatus, such as those in the preceding embodiments. For example, the present invention is also compatible with image forming apparatuses that form monochromatic images. Further, the selection of image forming apparatuses with which the present invention is compatible is not limited to image forming apparatuses that use an electrophotographic image forming method. That is, the present invention is also compatible with image forming apparatuses that use an image forming method other than the electrophotographic method. That is, the present invention is also applicable to image forming apparatuses that form a toner image with the use of an electrostatic recording method, or a magnetic recording method. Further, not only is the present invention compatible with image forming apparatuses of the so-called intermediary transfer type, such as those in the preceding embodiments, but also, image forming apparatuses of the so-called direct transfer type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

(A) a first rotatable member;

(B) a second rotatable member that cooperates with said first rotatable member to form a nip configured to heat a toner image on a recording material;

(C) a pressing mechanism including a pressing spring configured to press said first rotatable member toward said second rotatable member at opposite longitudinal ends of said first rotatable member; and (D) a pressure removal mechanism including:

(a) a camshaft;

(b) a first cam portion provided at one longitudinal end of said camshaft;

(c) a second cam portion provided at another longitudinal end of said camshaft, wherein said first cam portion and said second cam portion are capable of placing said pressing mechanism at a first position, in which said first rotatable member and said second rotatable member form the nip, and a second position, in which said pressing mechanism is moved against an urging force provided by said pressing spring at the first position and in which a force applied between said first rotatable member and said second rotatable member by said pressing mechanism is less than a force applied between said first rotatable member and said second rotatable member by said pressing mechanism when said pressing mechanism is in the first position, and wherein said cam shaft rotates said first cam portion and said second cam portion;

(d) a first bearing portion;

(e) a second bearing portion, said first bearing portion and said second bearing portion being provided between said first cam portion and said second cam portion with respect to a longitudinal direction of said camshaft, and configured to support said camshaft;

(f) a first supporting portion supporting said first bearing portion;

(g) a second supporting portion supporting said second bearing portion, wherein said first supporting portion and said second supporting portion rotatably support said camshaft;

(h) a driving mechanism configured to rotate said camshaft; and (i) a regulating portion configured to regulate flexure of said camshaft by contacting said camshaft at a position between said first bearing portion and said second bearing portion with respect to the longitudinal direction of said camshaft, when said pressing mechanism is in the second position.

2. The image heating apparatus according to claim 1, wherein a cross section of said camshaft, taken across the longitudinal direction of said camshaft, has a corner portion, and wherein said pressure removing mechanism further includes (j) a contact member configured to contact said regulating portion when said pressing mechanism is in the second position, said contact member being provided on said camshaft at a position between said first bearing portion and said second bearing portion with respect to the longitudinal direction.

3. The image heating apparatus according to claim 2, wherein said contact member is rotatable integrally with said camshaft.

4. The image heating apparatus according to claim 1, wherein said camshaft is provided with a sliding member, formed of a resin material, at a position contacting said regulating portion when said pressing mechanism is in the second position.

5. The image heating apparatus according to claim 1, wherein said regulating portion is provided at a central portion with respect to the longitudinal direction of said camshaft.

6. The image heating apparatus according to claim 1, wherein said first supporting portion and said second supporting portion rotatably support said first rotatable member.

7. The image heating apparatus according to claim 1, wherein said regulating portion extends in the longitudinal direction of said camshaft, and a portion of said regulating portion, contacting said camshaft when said pressing mechanism is in the second position, protrudes toward said camshaft.

8. An image heating apparatus comprising:

(A) a first rotatable member;

(B) a second rotatable member that cooperates with said first rotatable member to form a nip configured to heat a toner image on a recording material;

(C) a pressing mechanism including a pressing spring configured to press said first rotatable member toward said second rotatable member at opposite longitudinal ends of said first rotatable member; and (D) a pressure removal mechanism including:

(a) a camshaft;

(b) a first cam portion provided at one longitudinal end of said camshaft;

(c) a second cam portion provided at another longitudinal end of said camshaft, wherein said first cam portion and said second cam portion are capable of placing said pressing mechanism at a first position, in which said first rotatable member and said second rotatable member form the nip, and a second position, in which said pressing mechanism is moved against an urging force provided by said pressing spring at the first position and in which said first rotatable member and said second rotatable member are spaced from each other, and wherein said cam shaft rotates said first cam portion and said second cam portion;

(d) a first bearing portion;

(e) a second bearing portion, said first bearing portion and said second bearing portion being provided between said first cam portion and said second cam portion with respect to the longitudinal direction of said camshaft and configured to support said camshaft;

(f) a first supporting portion supporting said first bearing portion;

(g) a second supporting portion supporting said second bearing portion, wherein said first supporting portion and said second supporting portion rotatably support said camshaft;

(h) a driving mechanism configured to rotate said camshaft; and (i) a regulating portion configured to regulate flexure of said camshaft by contacting said camshaft at a position between said first bearing portion and said second bearing portion with respect to the longitudinal direction of said camshaft, when said pressing mechanism is in the second position.

9. The image heating apparatus according to claim 8, wherein a cross section of said camshaft, taken across the longitudinal direction of said camshaft, has a corner portion, and wherein said pressure removing mechanism further includes (j) a contact member configured to contact said regulating portion when said pressing mechanism is in the second position, said contact member being provided on said camshaft at a position between said first bearing portion and said second bearing portion with respect to the longitudinal direction.

10. The image heating apparatus according to claim 9, wherein said contact member is rotatable integrally with said camshaft.

11. The image heating apparatus according to claim 8, wherein said camshaft is provided with a sliding member, formed of a resin material, at a position contacting said regulating portion when said pressing mechanism is in the second position.

12. The image heating apparatus according to claim 8, wherein said regulating portion is provided at a central portion with respect to the longitudinal direction of said camshaft.

13. The image heating apparatus according to claim 8, wherein said first supporting portion and said second supporting portion rotatably support said first rotatable member.

14. The image heating apparatus according to claim 8, wherein said regulating portion extends in the longitudinal direction of said camshaft, and a portion of said regulating portion, contacting said camshaft when said pressing mechanism is in the second position, protrudes toward said camshaft in order to contact the camshaft and to minimize an amount of bending of the camshaft.

15. An image heating apparatus comprising:

(A) a first rotatable member;

(B) a second rotatable member that cooperates with said first rotatable member to form a nip configured to heat a toner image on a recording material;

(C) a pressing mechanism including a pressing spring configured to press said first rotatable member toward said second rotatable member at opposite longitudinal ends of said first rotatable member; and (D) a pressure removal mechanism including:

(a) a camshaft that has a cross section, taken across a longitudinal direction of said camshaft, having a corner portion;

(b) a first cam portion provided at one longitudinal end of said camshaft;

(c) a second cam portion provided at another longitudinal end of said camshaft, wherein said first cam portion and said second cam portion are capable of placing said pressing mechanism at a first position, in which said first rotatable member and said second rotatable member form the nip, and a second position, in which said pressing mechanism is moved against an urging force provided by said pressing spring at the first position and in which a force applied between said first rotatable member and said second rotatable member by said pressing mechanism is less than a force applied between said first rotatable member and said second rotatable member by said pressing mechanism when said pressing mechanism is in the first position, and wherein said camshaft is configured to rotate said first cam portion and said second cam portion;

(d) a first bearing portion;

(e) a second bearing portion, said first bearing portion and said second bearing portion being provided between said first cam portion and said second cam portion with respect to the longitudinal direction of said camshaft, and configured to support said camshaft;

(f) a first supporting portion supporting said first bearing portion;

(g) a second supporting portion supporting said second bearing portion, wherein said first supporting portion and said second supporting portion rotatably support said camshaft;

(h) a driving mechanism configured to rotate said camshaft;

(i) a first regulating member configured to regulate flexure of said camshaft at a position between said first bearing portion and said second bearing portion with respect to the longitudinal direction of said camshaft; and (j) a second regulating member provided on said camshaft at a position between said first bearing portion and said second bearing portion with respect to the longitudinal direction of said camshaft, said second regulating member regulating the flexure of said camshaft by approaching said first regulating portion when said pressing mechanism is in the second position.

16. The image heating apparatus according to claim 15, wherein said second regulating member is rotatable integrally with said camshaft.

17. The image heating apparatus according to claim 15, wherein said first regulating member extends in the longitudinal direction of said camshaft, and a portion of said first regulating member, which opposes said second regulating member, protrudes toward said second regulating member.

18. An image heating apparatus comprising:

(A) a first rotatable member;

(B) a second rotatable member that cooperates with said first rotatable member to form a nip configured to heat a toner image on a recording material;

(C) a pressing mechanism including a pressing spring configured to press said first rotatable member toward said second rotatable member at opposite longitudinal ends of said first rotatable member; and (D) a pressure removal mechanism including:

(a) a camshaft having a cross section, taken across a longitudinal direction of said camshaft, that has a corner portion;

(b) a first cam portion provided at one longitudinal end of said camshaft;

(c) a second cam portion provided at another longitudinal end portion of said camshaft, wherein said first cam portion and said second cam portion are capable of placing said pressing mechanism at a first position, in which said first rotatable member and said second rotatable member form the nip, and a second position, in which said pressing mechanism is moved against an urging force provided by said pressing spring at the first position and in which said first rotatable member and said second rotatable member are spaced from each other, and wherein said cam shaft rotates said first cam portion and said second cam portion;

(d) a first bearing portion;

(e) a second bearing portion, said first bearing portion and said second bearing portion being provided between said first cam portion and said second cam portion with respect to the longitudinal direction of said camshaft, and configured to support said cam shaft;

(f) a first supporting portion supporting said first bearing portion;

(g) a second supporting portion supporting said second bearing portion, wherein said first supporting portion and said second supporting portion rotatably support said camshaft;

(h) a driving mechanism configured to rotate said camshaft;

(i) a first regulating member configured to regulate flexure of said camshaft at a position between said first bearing portion and said second bearing portion with respect to the longitudinal direction of said camshaft; and (j) a second regulating member provided on said cam shaft at a position between said first bearing portion and said second bearing portion with respect to the longitudinal direction of said camshaft, said second regulating member regulating the flexure of said camshaft by approaching said first regulating portion when said pressing mechanism is in the second position.

19. The image heating apparatus according to claim 18, wherein said second regulating member is rotatable integrally with said camshaft.

20. The image heating apparatus according to claim 18, wherein said first regulating member extends in the longitudinal direction of said camshaft, and a portion of said first regulating member, which opposes said second regulating member, protrudes toward said second regulating member.

* * * * *